US005402803A

United States Patent [19]

Takagi

[11] Patent Number: 5,402,803

[45] Date of Patent: Apr. 4, 1995

[54] SMOKING DEVICE FOR HEAT-DECOMPOSING CIGARETTE SMOKE

[76] Inventor: Seiichi Takagi, 712-81, Ooazanakanuki, Tsuchiura-shi, Ibaraki-ken, Japan

[21] Appl. No.: 18,945

[22] Filed: Feb. 17, 1993

[30] Foreign Application Priority Data

Feb. 24, 1992 [JP] Japan ..... 4-086712
Jan. 1, 1993 [JP] Japan ..... 5-028387

[51] Int. Cl.[6] ..... A24F 13/02

[52] U.S. Cl. ..... 131/200; 131/202; 131/215.1; 55/210

[58] Field of Search ..... 131/200, 185, 330, 193, 131/194, 202, 203, 215.1, 215.3; 55/210, 385.8

[56] References Cited

U.S. PATENT DOCUMENTS

| | | | |
|---|---|---|---|
| 2,398,695 | 4/1946 | Cloutier | 131/185 |
| 2,588,034 | 3/1952 | O'Neill | 131/185 |
| 2,620,804 | 12/1952 | McMahon | 131/185 X |
| 4,018,568 | 4/1977 | Brewer | 55/210 X |
| 4,328,795 | 5/1982 | Cobaniss, III | 131/185 X |
| 4,774,970 | 10/1988 | Bell | 131/185 X |
| 5,048,545 | 9/1991 | Takagi et al. | 131/330 |
| 5,088,508 | 2/1992 | Duncan | 55/385.8 X |

FOREIGN PATENT DOCUMENTS 2-90992 7/1990 Japan .

*Primary Examiner*—Jennifer Bahr
*Attorney, Agent, or Firm*—Volpe and Koenig

[57] ABSTRACT

A smoking device for smoking of a cigarette having a tip end portion and a burning end portion has a housing assembly defining a heating chamber and having an exhaust port, an air port and an opening which all communicate with the heating chamber, a mouthpiece for supporting the cigarette such that the burning end portion of the cigarette is located within the heating chamber, a burner device for heating and decomposing at least one of the component of the main-flow smoke and the component of sub-flow smoke, and a smoke passage having an inlet as a first end portion, from which main-flow smoke is introduced, and a second end portion, from which the main-flow smoke is exhausted. The second end portion of the smoke passage is located within the heating chamber and surrounds the flame of the burner device so as to direct the main-flow smoke towards the tip of the flame of the burner device.

5 Claims, 26 Drawing Sheets

SMOKING DEVICE FOR HEAT-DECOMPOSING CIGARETTE SMOKE

BACKGROUND OF THE INVENTION

1. Field of the Invention

The present invention relates to a smoking device for heat-decomposing main-flow smoke and sub-flow smoke of a cigarette, thereby detoxicating the main-flow smoke and sub-flow smoke.

2. Description of the Related Art

Cigarette smoke consists of main-flow smoke (main stream), which is white smoke inhaled by a smoker from a cigarette tip, and sub-flow smoke (side stream) arising from a burning end of the cigarette.

In general, cigarette smoke contains about 4000 or more chemical substances, and about 200 or more of them are harmful to health. Of these, nicotine, carbon monoxide, tar, benzpyrene and nitrosoamine are particularly harmful.

The sub-flow smoke contains a greater amount of harmful substances than the main-flow smoke. If a non-smoker is exposed to the sub-flow smoke, the non-smoker's health is damaged. Under the circumstances, a movement isolating the non-smoker's space and time from the smokers' has been developed. As measures for such movement, there has been proposed some devices or methods. For example, an ashtray is provided with a filter having a fan, an ashtray is provided with a purifying unit such as a minus-ion generator, or air with smoke is purified by an activated carbon-containing filter which covers the entire cigarette.

Cigarette smoke consists of a particle portion and a gas portion. The particle portion can be substantially filtered by a purifying unit such as a filter, but it is difficult to remove the harmful gas portion from the cigarette smoke. In particular, the sub-flow smoke contains a considerable amount of harmful gas components, and it is difficult to instantaneously remove the harmful gas components through the purifying unit.

Compared to the above methods, a method of heat-decomposing the component of the cigarette is excellent in that not only particle component but also gas component is decomposed. The applicant of the present application has proposed various types of smoking devices using the heat-composition method. For example, the applicant's Published Unexamined Japanese Utility Model Application No. 2-90992 discloses a smoking device having a housing with an exhaust port and an air port. The housing defines a heating chamber in which a burning end of a cigarette is located. Main-flow smoke is introduced into the heating chamber. Within the heating chamber, the components of the main-flow smoke and sub-flow smoke of cigarette are heat-decomposed by an electric heater, a combustion device which produces a flame, or the like.

However, in the smoking device according to Application No. 2-90992, a large quantity of energy is required to heat-decompose the component of the main-flow smoke. When the main-flow smoke is introduced into the heating chamber, the flame of the combustion device having high portability and practicability may be extinguished by the air containing the main-flow smoke. These pose a serious problem in putting the smoking device into practical use.

SUMMARY OF THE INVENTION

The object of the present invention is to provide a practical smoking device which can eliminate harmful effects of cigarettes with a minimum amount of energy, without extinguishing a flame of a heating device.

A smoking device according to the invention comprises a heating chamber defined by a housing having an exhaust port and an air port; a cigarette supporting member for supporting a cigarette such that a burning end of the cigarette is located within the heating chamber; a pipe into which main-flow smoke is introduced, and heat-decomposition means for heat-decomposing the component of the cigarette smoke.

According to this structure, sub-flow smoke is heat-decomposed within the heating chamber by the heat-decomposition means in accordance with a natural convection. The main-flow smoke is introduced into the pipe and processed separately from the sub-flow smoke.

According to a first method of processing the main-flow smoke, the direction of the main-flow smoke introduced into the heating chamber through the pipe is determined. The main-flow smoke is let to flow from the surrounding of the flame of a combustion device towards the tip portion of the flame. Thereby, the flame of the combustion device is not put out.

According to a second method, the main-flow smoke is fed to a gas collector via a pipe and temporarily stored in the gas collector. The gas in the collector is slowly fed into the heating chamber, and the component of the main-flow smoke is heat-decomposed.

According to a third method, air fed from the pipe, which contains the main-flow Smoke, is purified by a purifying member comprising a filter or the like.

According to a fourth method, main-flow smoke from the pipe is stored in a large-sized gas collector.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

A first embodiment of the smoking device according to the present invention will now be described with reference to accompanying FIGS. 1 to 5.

Figure 1:
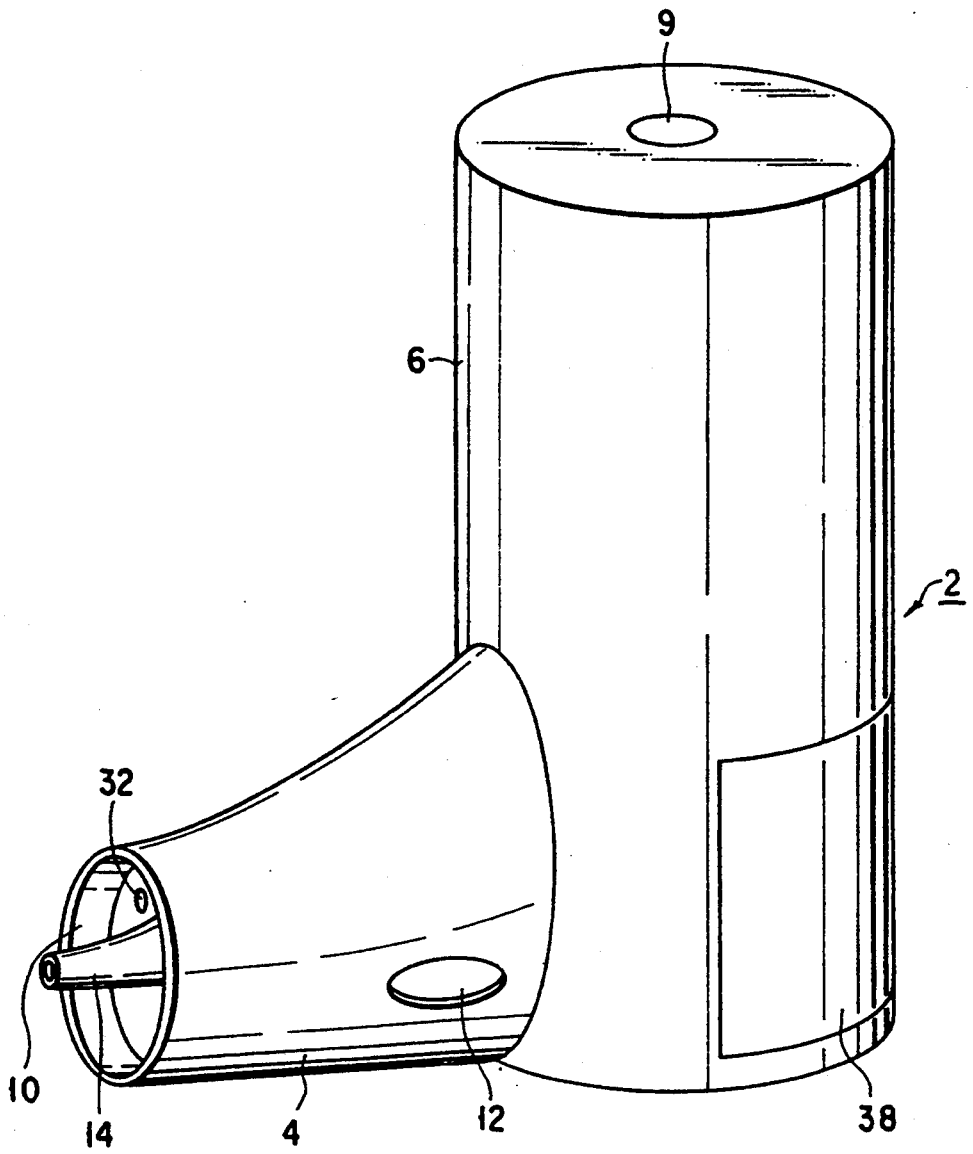
FIG. 1 is a perspective view of a smoking device according to a first embodiment of the present invention.

Referring to FIG. 1, a housing assembly 2 comprises a first housing 4 and a second housing 6. The housing assembly 2 is provided with an exhaust port 9.

Figure 2:
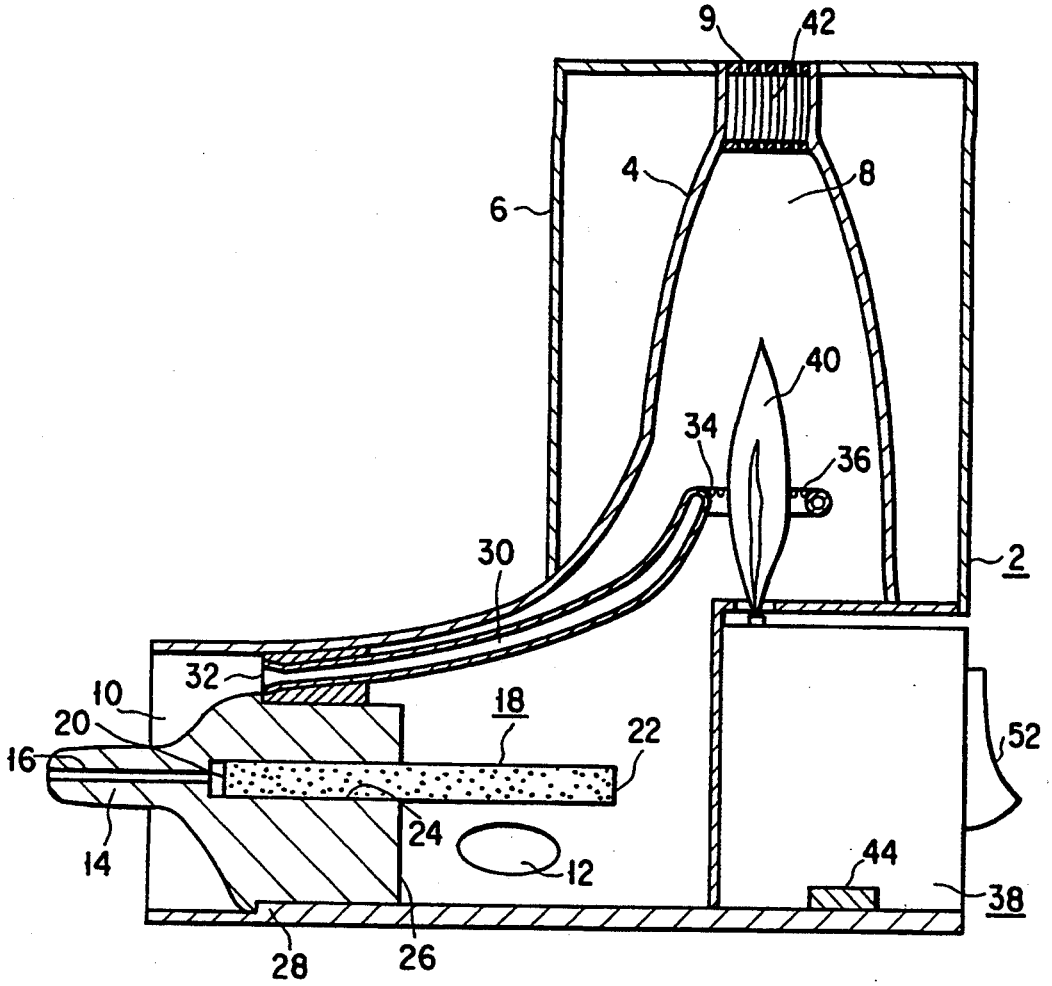
FIG. 2 is a vertical cross-sectional view of the smoking device shown in FIG. 1.

As is shown in FIG. 2, thee first and second housings 4 and 6 define a heating chamber 8. The first housing 4 is provided with an opening portion 10 and an air vent 12. A mouthpiece 14 is detachably mounted in the opening portion 10. The mouthpiece 14 has a very small-diameter first hole 16 and a second hole 24 into which a cigarette 18 is inserted from its tip 20. The first hole 16 communicates with the second hole 24. That portion of the mouthpiece 14, which defines the first and second holes 16 and 24, is formed of a metallic or ceramic material.

The second hole 24 has such a length as to sufficiently hold the cigarette 18. The distance between a burning end 22 of the cigarette 18 and an end face 26 of the mouthpiece 14 is desirably adjusted. When the burning end 22 of cigarette 18 is lighted up, the cigarette 18 is burnt to the end face 26 of mouthpiece 14. Then, the, heat of cigarette 18 is absorbed by the mouthpiece 14 and then the fire of cigarette 18 goes out naturally.

The first housing 4 is provided with an engaging portion 28 for engagement with the mouthpiece 14 to which the cigarette 18 is attached. An inlet (i.e. first end portion) 32 of a smoke passage 30 is situated above the mouthpiece 14. Main-flow smoke exhaled by the smoker is introduced into the inlet 32.

Figure 3:
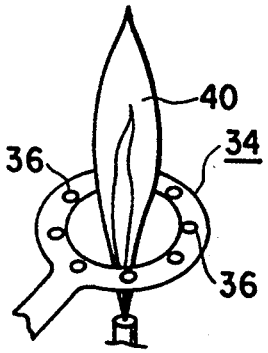
FIG. 3 is a perspective view showing smoke outlets and a flame of a burner device shown in FIG. 2.

The smoke passage 30 has a second end portion 34 having a circular shape, as shown in FIG. 3. A plurality of small holes are formed along the circle of the second end portion 34, thereby constituting a main-flow smoke outlet 36. The second end portion 34 of the passage 30 is formed so as to surround a flame 40 of a burner device 38.

The outlet 36 is situated at a relatively higher position so that the flame 40 of burner device 38 may not be put out by the breath of the smoker.

Figure 4:
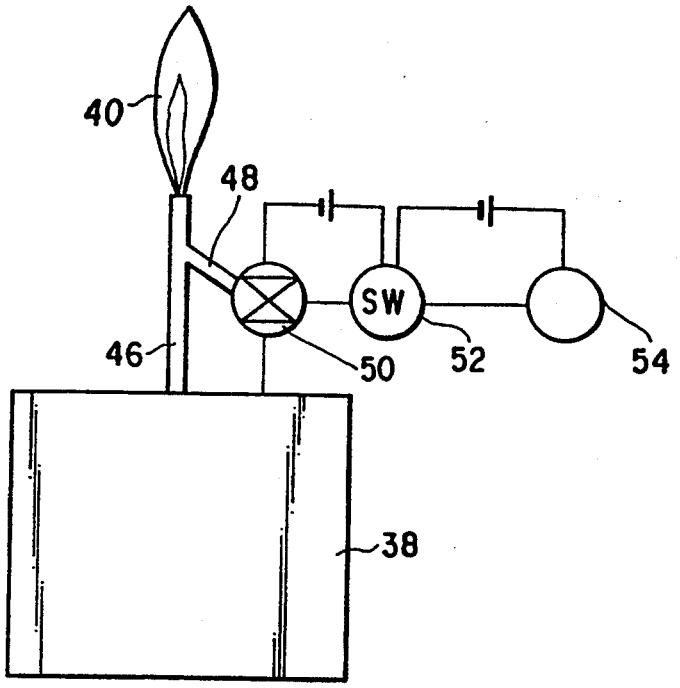
FIG. 4 shows the details of the burner device.

A catalyst portion 42 is provided above the heating chamber 8. The catalyst portion 42 includes a metal such as platinum, copper, silver, iron or zinc, or an oxide of the metal, or an oxide catalyst, or the like. The catalyst portion 42 serves also as heat accumulation member. When the main-flow smoke is introduced, the gas temperature of the smoke is increased to facilitate heat-decomposition The burner device 38 is provided with a magnet attachment portion 44 for easy attachment/detachment. As is shown in FIG. 4, the burner device 38 has a fuel jet pipe 46 for sucking a predetermined amount of fuel from a fuel tank (not shown). The fuel jet pipe 46 is connected to an auxiliary pipe 48. Fuel is supplied through the auxiliary pipe 48 to the fuel jet pipe 46 so as to control the flame 40.

The auxiliary pipe 48 is provided with an electromagnetic valve 50. A switch 52 is connected to the electromagnetic valve 50, and a breathing piezoelectric sensor 54 is connected to the switch 52. The sensor 54 is attached to the inlet 32, and it senses the intensity of introduced main-flow smoke of the smoker.

The operation of the smoking device according to the first embodiment, which has the above-described structure, will now be described.

The smoker removes the mouthpiece 14 from the first housing 4, inserts the tip 20 of cigarette 18 into the second hole 24, and desirably adjusts the distance between the burning end 22 and the end face of the mouthpiece 14. Then, the burning end 22 is lighted, and the mouthpiece 14 is mounted in the first housing 4 once again.

Figure 5:
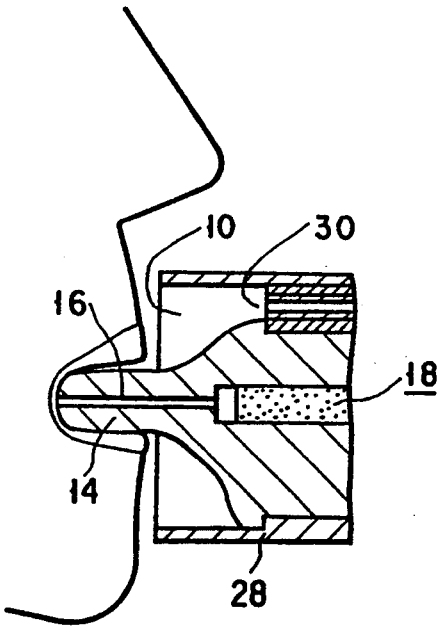
FIGS. 5 and 6 show methods of use of the smoking device shown in FIG. 1, FIG. 5 being a cross-sectional view showing the state in which a smoker inhales cigarette smoke, and FIG. 6 bring a cross-sectional view showing the state in which the smoker exhales the main-flow smoke.
Figure 6:
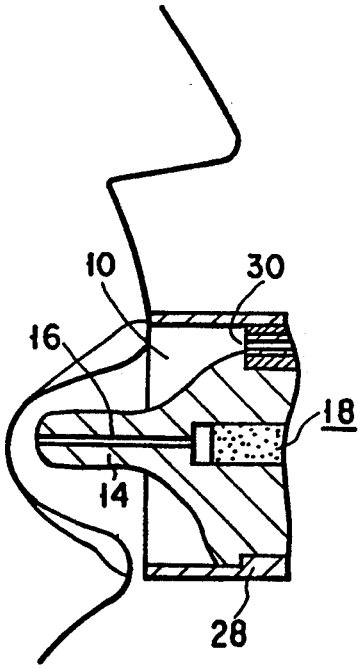

The smoker holds the mouthpiece 14 in his/her mouth and inhales main-flow smoke, as shown in FIG. 5. When the smoker exhales main-flow smoke, he/she opens his/her mouth to the same degree as the size of the opening 10, as shown in FIG. 6. The exhaled main-flow smoke flows from the inlet 32 (shown in FIG. 2) to the outlet 36 through the passage 30. In this case, the breath of the smoker is sensed by the sensor 54 (shown in FIG. 4), and the electromagnetic valve 50 is actuated by the sensor 54. Thereby, auxiliary fuel is supplied from the auxiliary pipe 48 to the fuel jet pipe 46. Accordingly, when the main-flow smoke is introduced, the flame 40 increases.

Inversely, when the main-flow smoke is not introduced, the auxiliary pipe 48 is closed by the electromagnetic valve 50. Thus, auxiliary fuel is not supplied to the Jet pipe 46. In the state in which the auxiliary fuel is not supplied, a minimum necessary amount of fuel is fed. Accordingly, in this state, the flame 40 has a minimum magnitude for heat-decomposing the components of the sub-flow smoke arising from the cigarette 18. As a result, a danger due to heat is low, and heat energy is saved.

The components of the main-flow smoke introduced from the inlet 36 is heat-decomposed by the flame 40. As stated above, since the flame 40 is large while the smoker exhales the main-flow smoke, the combustion of the components of the main-flow smoke flowing from the outlet 36 is facilitated.

If there is any component of the main-flow smoke, which has not been burnt by the flame 40, the component is accumulated in the catalyst portion 42. After the air containing the main-flow smoke is completely purified by the catalyst portion 42, it is exhausted from the exhaust port 9.

On the other hand, the components of the sub-flow smoke arising from the burning end 22 of cigarette 18 is partly burnt and heat-decomposed by the flame 40 in the heating chamber 8. The component of the sub-flow smoke, which has not been heat-decomposed, is accumulated in the catalyst portion 42. After the air containing the sub-flow smoke is completely purified by the catalyst portion 42, it is exhausted from the exhaust port 9.

In this manner, the components of both main-flow smoke and sub-flow smoke are teat-decomposed and thus detoxified.

According to this embodiment, since the main-flow smoke can be blown from the outlet 36 toward the flame, the components of main-flow smoke can be heat-decomposed without extinguishing the flame. In addition, since the main-flow smoke is blown out in the vicinity of the flame, the heat decomposition efficiency of the components of the main-flow smoke is increased. Since the inlet 32 is near the mouthpiece 14 in the opening portion 10, the action of inhaling cigarette smoke and the action of introducing the main-flow smoke can be performed conveniently at the same opening portion 10.

In the present embodiment, the burner device 38 is employed as heat-decomposition means, but the burner device 38 may be a gas burner, a candle, an electric heater, etc. In the case of an electric heater, the electromagnetic valve 50 shown in FIG. 4 is replaced by a heater circuit switch.

When the flame of the burner device 38 or the output of the electric heater is controlled without using the circuit shown in FIG. 4, the burner device 38 or electric heater is provided with a push-lever and the flame or output of the electric heater is controlled by the push-lever.

When a candle is used for the burner device 38, the length of the candle decreases as it burns. Thus, the magnet attachment portion 44 may be attached to the side of a candle base, and the portion 44 may be situated at the side wall of the first housing 4. The burner device 38 may be provided with an automatic extinction timer which is set to extinguish the cigarette 18 after the time of burning of one cigarette 18 has passed.

A smoking device according to a second embodiment of the invention will now be described with reference to FIGS. 7 and 8. The parts of the second embodiment, which are common to those of the first embodiment, are denoted by same reference numerals, and the structure and operation of only different parts will be described. The same applies to the third to 15th embodiments.

Figure 7:
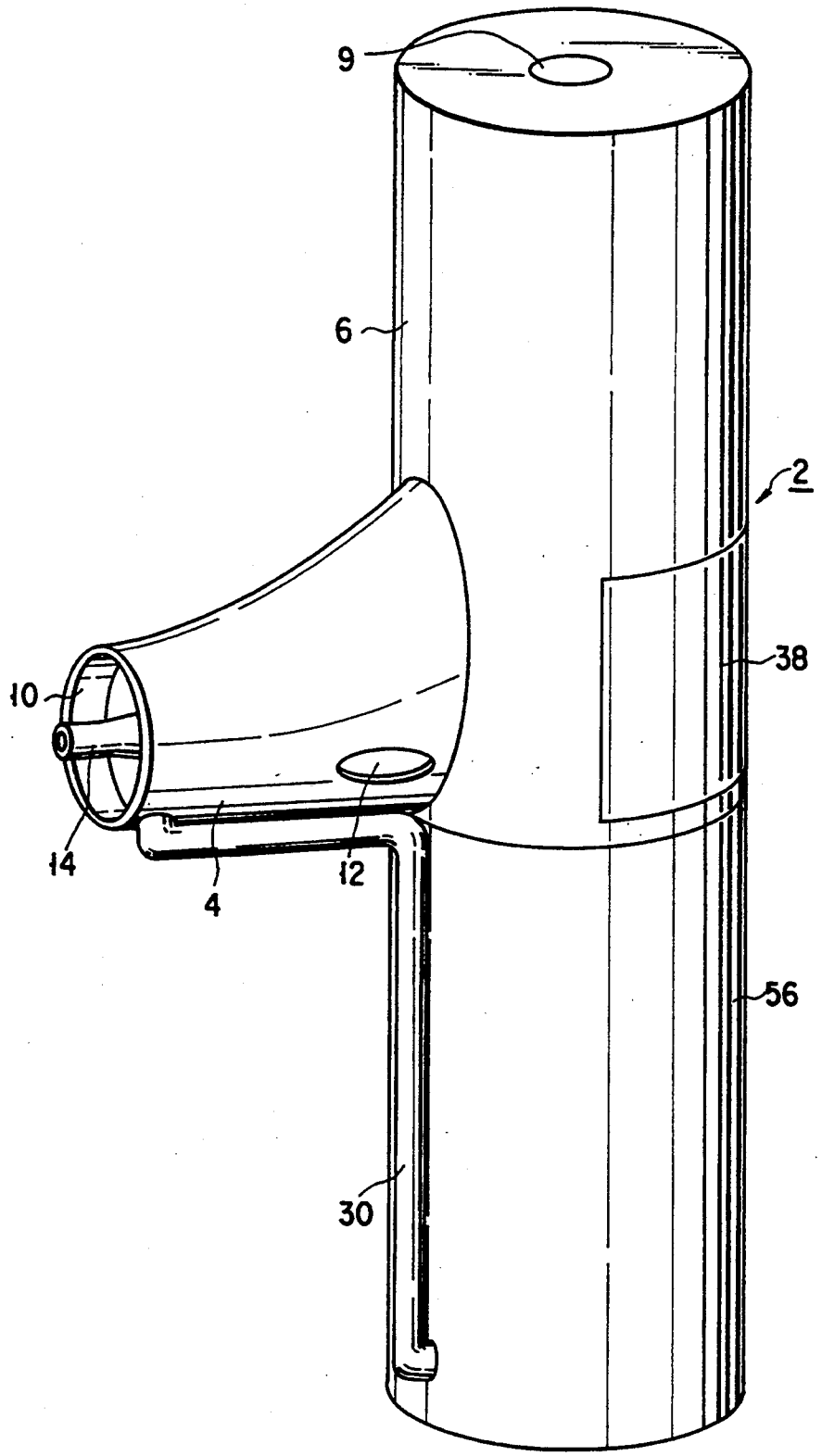
FIG. 7 is a perspective view showing a smoking device according to a second embodiment of the invention.
Figure 8:
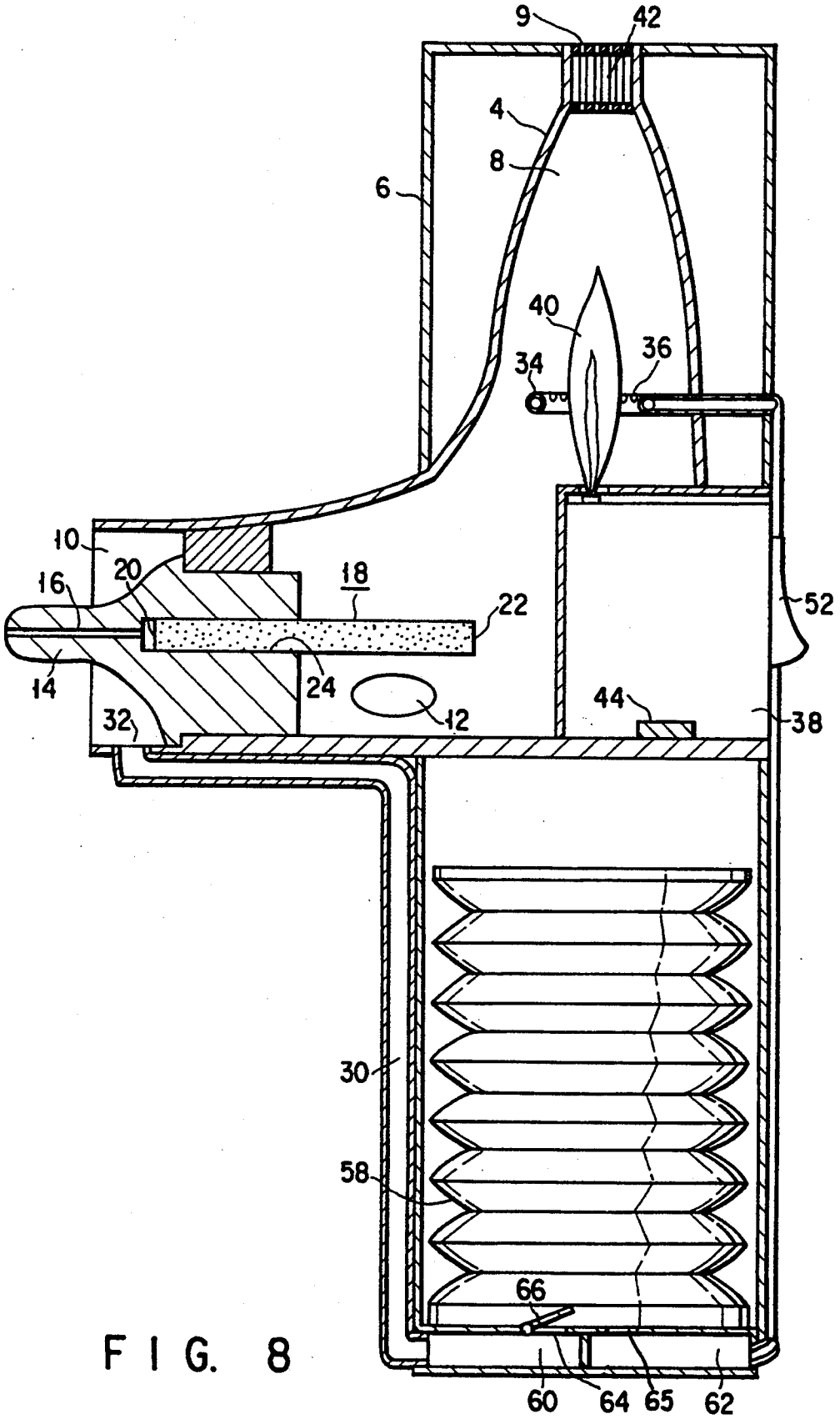
FIG. 8 is a vertical cross-sectional view of the smoking device shown in FIG. 7.

As is shown in FIG. 7, a third housing (casing) 56 is added to the housing assembly 2. The third housing 56 contains a bellows-type gas collector 58, as shown in FIG. 8. The gas collector 58 is hollow, and its upper part is closed and its lower part is opened.

The bottom portion of the third housing 56 is provided with a first chamber 60 and a second chamber 62. Each of the first and second chambers 60 and 62 has a very small hole 64, 65. The hole 64 of the first chamber 60 is provided with a check valve 66. The diameter of the hole 64 is set larger than that of the hole 65 of the second chamber 62.

An inlet 32, which constitutes a first end portion of a passage pipe 30, is situated in the vicinity of the mouthpiece 14. The pipe 30 extends through the first and second chambers 60 and 62, and not through the inside of the heating chamber, and a second end portion 34 of the pipe 30 is open within the heating chamber 8.

In the smoking device of the second embodiment, the main-flow smoke introduced into the inlet 32 by the smoker flows through the pipe. 30, first chamber 60 and the small hole, 65 and enters the gas collector 58. The main-flow smoke in the gas collector 58 flows through the large hole 64 of the second chamber 62 towards the second end portion 34 of the pipe 30. Since the hole 65 is very small, the air containing the main-flow smoke is accumulated in the gas collector 58. Accordingly, the size of the gas collector 58 increases.

After the exhalation of the main-flow smoke by the smoker is completed, the collector 58 decreases in size by its own weight. Thus, the air containing the main-flow smoke is exhausted from the collector 58 and fed to the second end portion 34. Since the check valve 66 is attached to the first chamber 60, the air containing the main-flow smoke does not flow back towards the inlet 32 during exhaustion by the collector 58.

The other structural features and operations are the same as those of the first embodiment.

In the present embodiment, the main-flow smoke is temporarily stored in the collector 58 and is slowly exhausted from the outlet 36 for heating, the heating energy is remarkably saved and the safety against fire can be ensured.

In this embodiment, the gas collector 58 has a bellows shape, but it may be replaced by a balloon on which weights are provided at some locations so that the balloon may be contracted.

Figure 9:
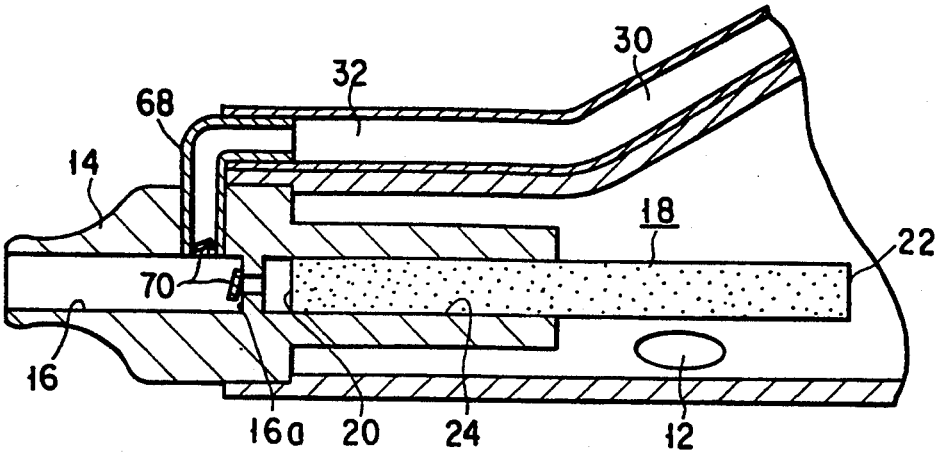
FIG. 9 is a cross-sectional view showing a modification of a mouthpiece.

Next, a modification of the mouthpiece 14 will now be described. A connection pipe 68 is connected to the first hole 16 of the mouthpiece 14, as shown in FIG. 9. The connection pipe 68 is also connected to the inlet 32. Check valves 70 are attached to the bottom 16*a* of the first hole 16 and to the connection pipe 68. Using this mouthpiece 14 makes it possible for the smoker to inhale cigarette smoke from the cigarette 18 and exhale main-flow smoke while having the mouthpiece 14 in his/her mouth. In this case, since two check valves 70 are located, the main-flow smoke does not flow into the second hole 24, nor does the smoker inhale the main-flow smoke within the pipe 30.

A third embodiment will now be described.

Figure 10:
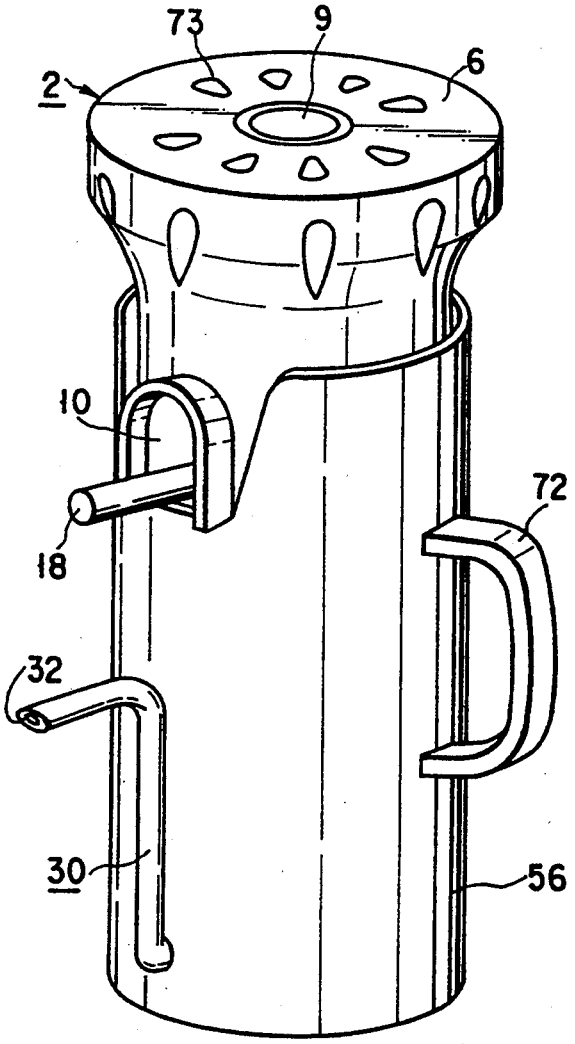
FIG. 10 is a perspective view showing a smoking device according to a third embodiment of the invention.
Figure 11:
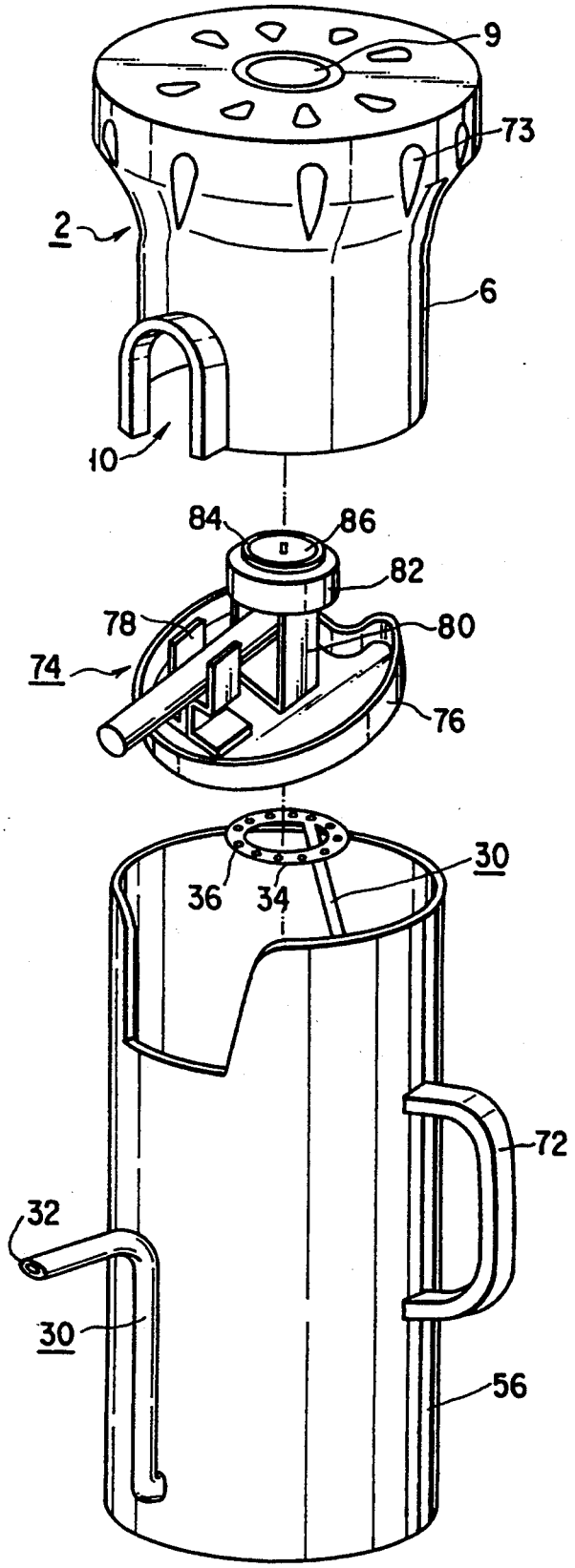
FIG. 11 is an exploded perspective view of the smoking device shown in FIG. 10.
Figure 12:
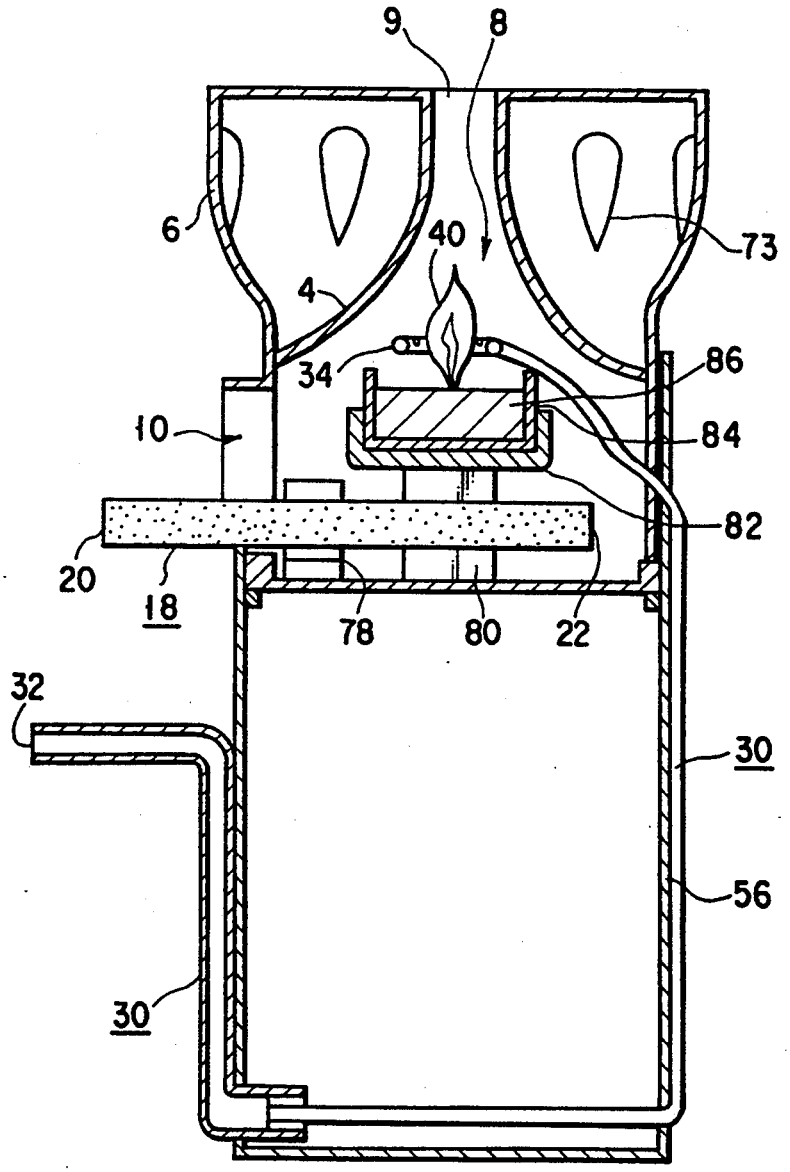
FIG. 12 is a vertical cross-sectional view of the smoking device shown in FIG. 10.

As is shown in FIGS. 10 to 12, a third housing 56 has a container-shaped structure in which the housing assembly 2 consisting of first and second housings 4 and 6 is fitted. A handle 72 is attached to the third housing 56. The smoking device can be easily carried by virtue of the handle 72.

As is shown in FIG. 12, the opening 10 which is located in the housing assembly 2 is used for inserting the cigarette 18. The first housing 4 is formed to define an inverted-funnel shaped heating chamber 8. The second housing 6 covers the outer wall of the heating chamber 8. The second housing 6 is provided with a plurality of air holes 73, thereby letting heat escape from the heating chamber 8.

A cigarette supporting mechanism 74 for supporting the cigarette 18 is provided between the housing assembly 2 and the third housing 56, as shown in FIG. 11.

The cigarette supporting mechanism 74 has an ashtray 76 serving as a base of the mechanism 74. A support member 78 and a fixing member 80 are attached on the ashtray 76. The support member 78 supports a portion of the cigarette 18 between its tip end 20 and burning end 22. A case 82 is secured to the fixing member 80. A candle 86 contained in a metallic container 84 is put in the case 82.

A passage pipe 30 is attached to the third housing 56. The inlet 32 of the pipe 30 is situated near the tip portion 20 of cigarette 18.

The smoking device according to the third embodiment is used in the following manner. After cigarette smoke of the cigarette 18 is inhaled along with the outside air, the main-flow smoke is introduced into the smoke passage pipe 30. The air containing the main-flow smoke is fed to the second end portion 34 from the inlet 32 (i.e. the first end portion of the pipe 30).

Figure 13:
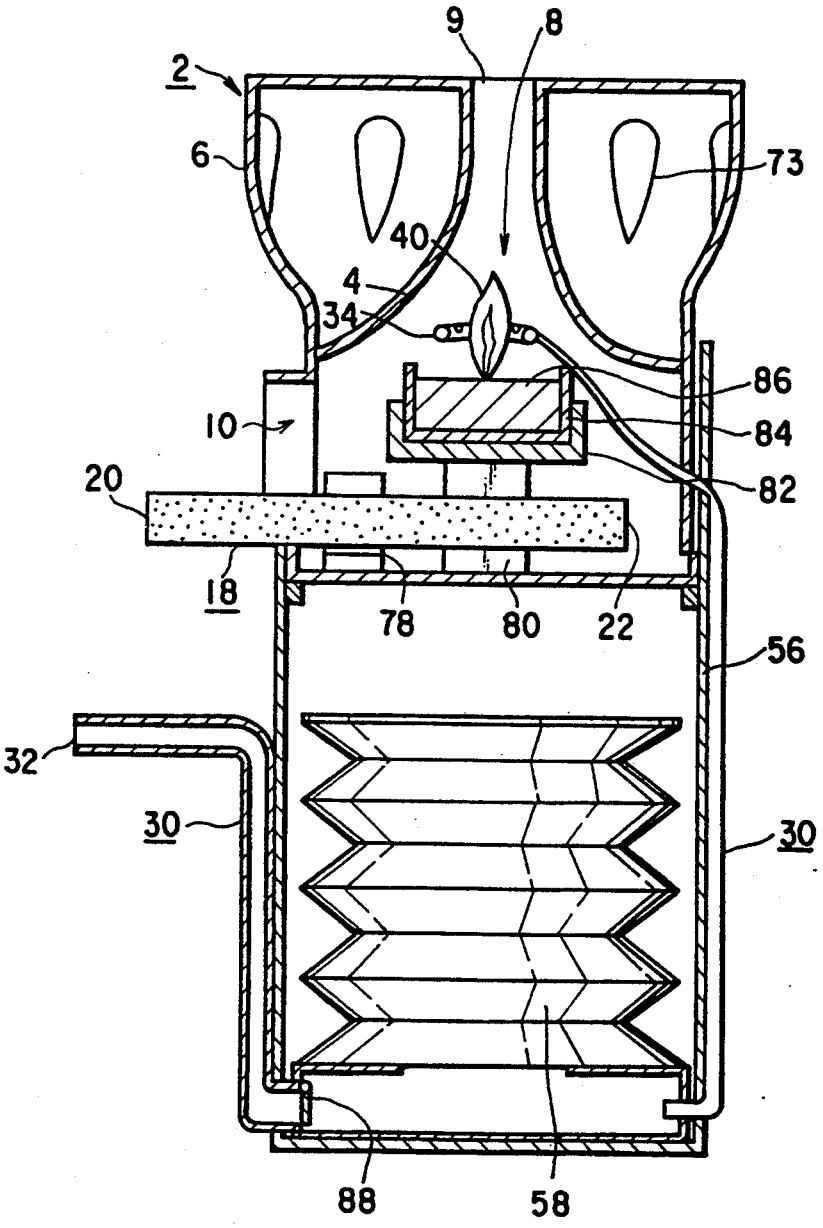
FIG. 13 is a vertical cross-sectional view of a smoking device according to a fourth embodiment of the invention.

A fourth embodiment will now be described. As is shown in FIG. 13, a check valve 88 and a bellows-shaped gas collector 58 are coupled in a middle portion of the main-flow smoke passage pipe 30. The gas collector 58 contracts by its own weight, and the air containing the main-flow smoke is exhausted towards the second end portion 34.

Like the third embodiment, according to the fourth embodiment, the smoker exhales the air containing the main-flow smoke into the pipe 30, and the air is collected in the gas collector 58. Thus, the gas collector 58 extends. The gas collector 58 feeds the smoke to the second end portion 34 of the pipe 30 by its own weight. In this case, the check valve 88 prevents the smoke from flowing back to the pipe 30. The smoke exhausted from the second end portion 34 and sub-flow smoke arising from the cigarette 18 attached to the cigarette supporting member 78 are heat-decomposed by the candle 86, and harmless gas is exhausted from the exhaust port 9. The housing assembly 2 can be fitted in the third housing 56 having the candle 86 and cigarette 18, and therefore the attachment, lighting, and extinction of cigarette 18 is easy.

Figure 14:
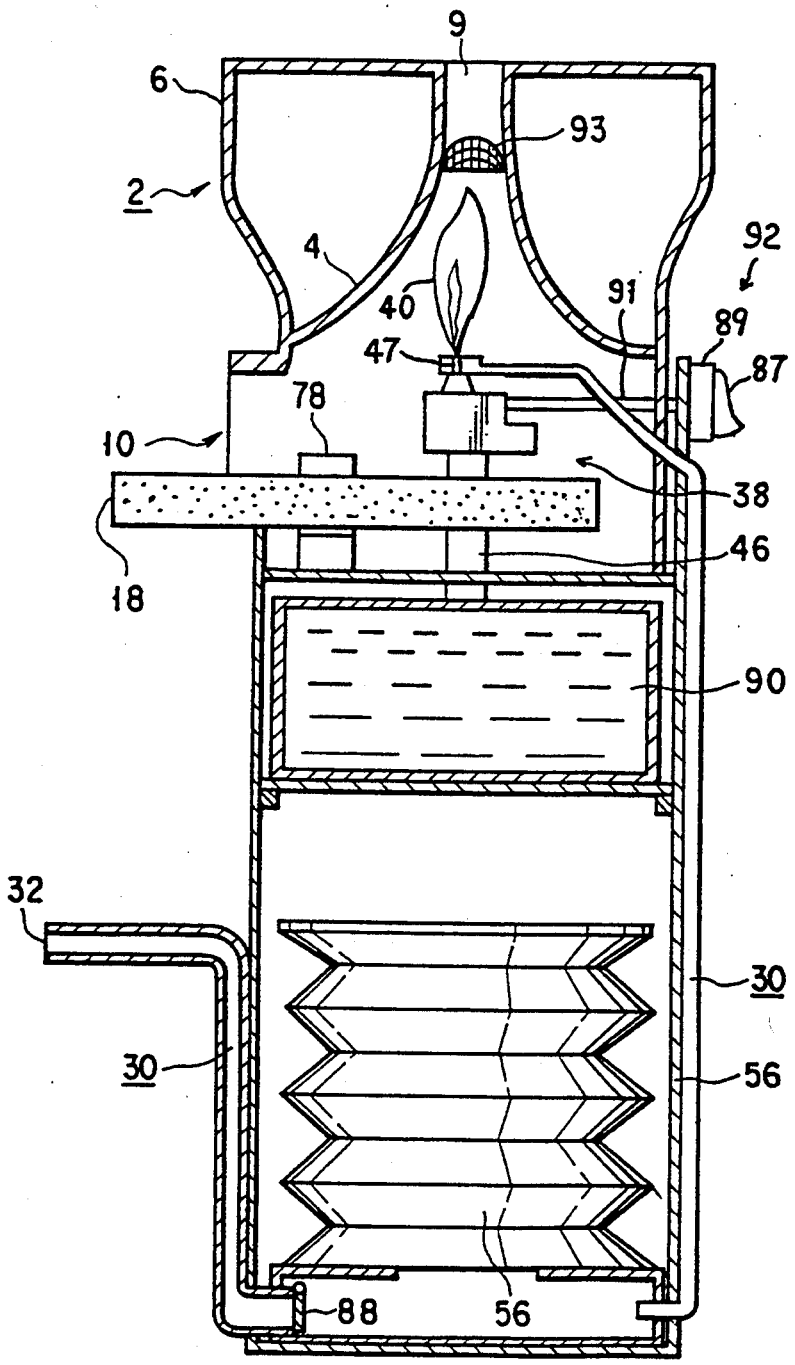
FIG. 14 is a vertical cross-sectional view of a smoking device according to a fifth embodiment of the invention.

A fifth embodiment of the invention will now be described. As is shown in FIGS. 14, a lighter-type burner device 38 is used as heating means. The burner device 38 comprises a fuel tank 90, a fuel jet pipe 46 and a lighting portion 92. The exhaust port 9 is provided with a metallic net 93.

The lighting portion 92 has a switch 87 which is electrically connected to a piezoelectric element (not shown) located in a box 89. The piezoelectric element in the box 89 is connected to a lead wire (not shown) extending in a tube 91 to the distal end 47 of the fuel jet pipe 46. Accordingly, an user can make a flame 40 outside the housing assembly 2 by turning on the switch 87.

The operation of the fifth embodiment is substantially identical to that of the fourth embodiment.

Figure 15:
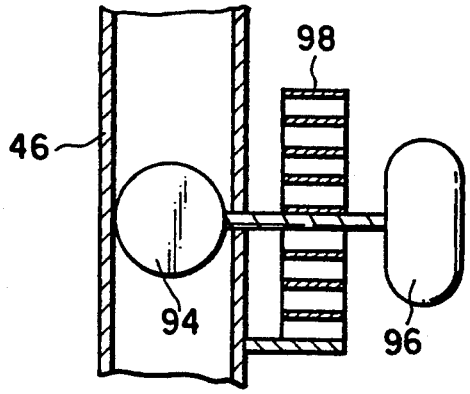
FIG. 15 is a cross-sectional view showing an example of a valve opening/closing mechanism.
Figure 16:
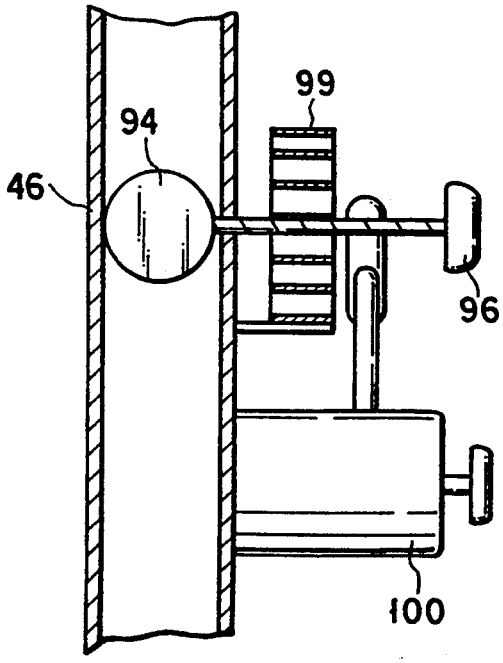
FIG. 16 is a cross-sectional view showing another example of a valve opening/closing mechanism.

FIGS. 15 and 16 show examples of a safety device of the burner device 38. In FIG. 15, a valve 94 is provided within the fuel jet pipe 46. The valve 94 has a cock 96. The cock 96 is provided with a shape memory alloy spring 98 for sensing an ambient temperature rise. Thereby, the spring 98 senses the ambient temperature and automatically controls the valve 94, thus closing the fuel jet pipe.

In the embodiment of FIG. 16, a timer switch 100 is used, taking into account the fact that the time of burning of one cigarette is substantially constant. A spring 99 is formed of an ordinary material, and not a shape memory alloy. The spring 99 urges the cock 96 in such a direction as to close the valve 94. The timer switch 100 functions as a stopper for limiting the rotation of the cock 96 in accordance with the set time. The cock 96 is rotated during smoking to open the fuel jet pipe 46, and this open state is maintained by the timer switch 100. After a predetermined time period, the stopper function of the cock 96 by the timer switch 100 is released, and the cock 96 is rotated by the spring 99. Thus, the valve 94 automatically closes the fuel jet pipe 46.

Figure 17:
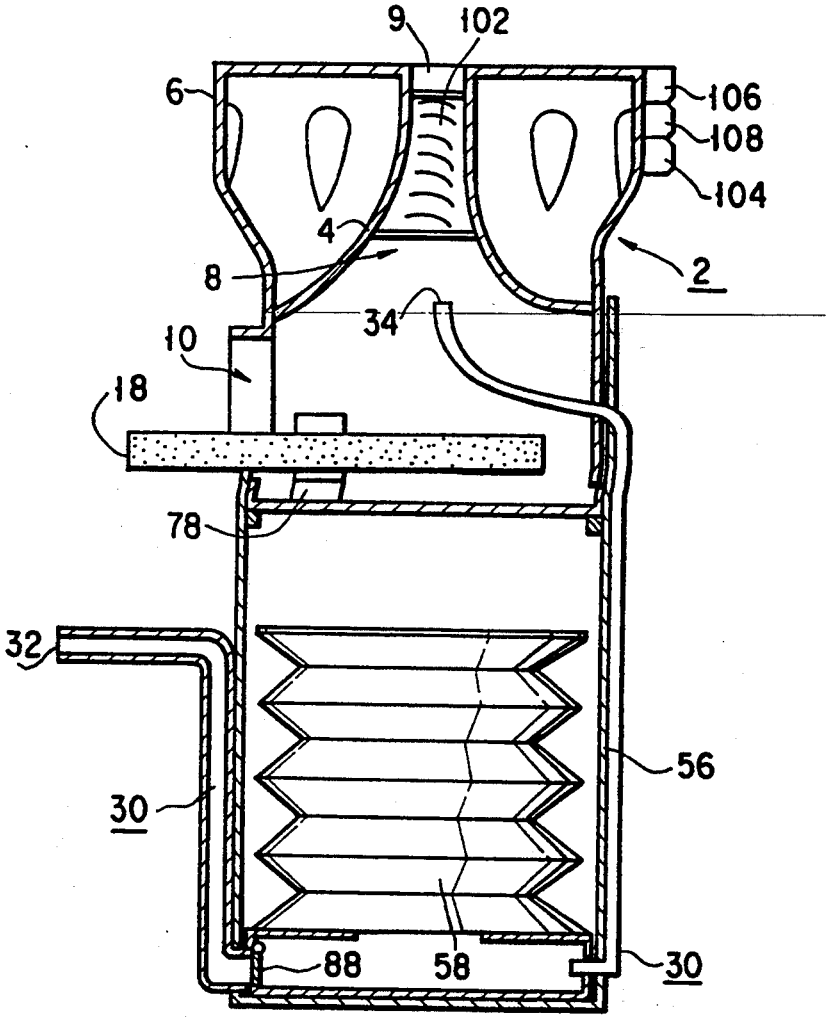
FIG. 17 is a vertical cross-sectional view of a smoking device according to a sixth embodiment of the invention.
Figure 18:
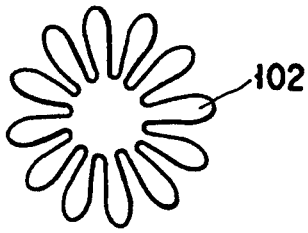
FIG. 18 is a cross-sectional view of an electric heater unit, taken along a horizontal line in FIG. 17.

A sixth embodiment of the invention will now be described. As is shown in FIG. 17, an electric heater unit 102 is used as heat-decomposition means. The electric heater unit 102 is connected to a switch 104 for turning on/off the electric heater unit 102, a pilot lamp 106 which emits light during power-supply time as safety device and a timer switch 108 for automatically turning off the switch 104 after the smoking time of one cigarette. The electric heater unit 102 has such a coil shape that a wire is bent in a zigzag manner in a horizontal direction, as shown in FIG. 18.

The operation of the sixth embodiment is substantially identical to the operations of the fourth and fifth embodiments.

Figure 19:
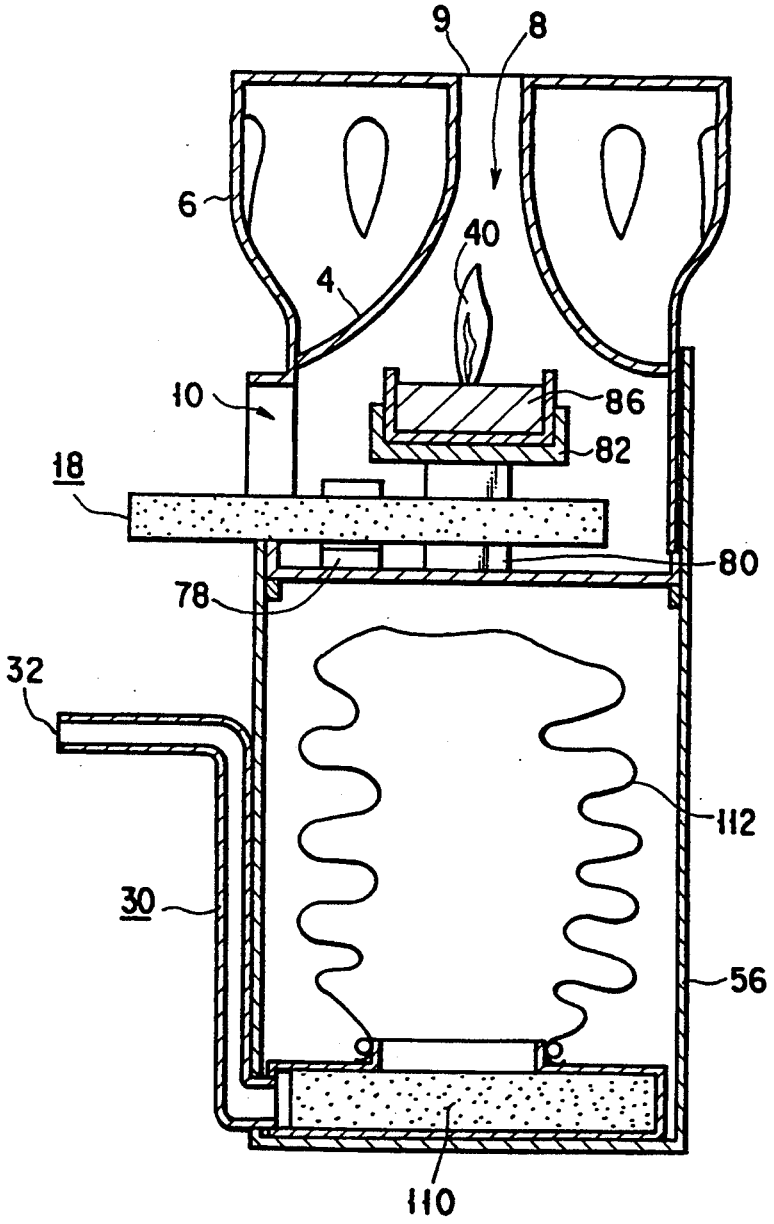
FIG. 19 is a cross-sectional view showing a smoking device according to a seventh embodiment of the invention.

FIG. 19 shows a seventh embodiment of the invention. The main-flow smoke pipe 30 communicates with a plastic film-like contractile gas collector 112 via a purifying unit 110. When the gas collector 112 is swollen, it is necessary that the collector 112 maintain its shape without contracting by its own weight. This object can be achieved by use of thin plastic film, but it is possible that a bellows-shaped balloon is placed horizontally and extended/contracted. The purifying unit 110 comprises a filter or activated carbon.

In the seventh embodiment, the main-flow smoke is put into the gas collector 112 via the pipe 30 and purifying unit 110. The smoke is kept in the gas collector 112 while the swollen state of the collector 112 is maintained. After the smoker has inhaled the cigarette smoke, he/she puts his/her mouth on the pipe 30 and inhales, instead of outside air, the main-flow smoke stored in the contractile gas collector 112 via the purifying unit 110. Then, the smoker introduces the gas into the pipe 30 once again. During this time, the sub-flow smoke is heat-decomposed by the candle 86 and resultant harmless gas is exhausted from the exhaust port 9.

Figure 20:
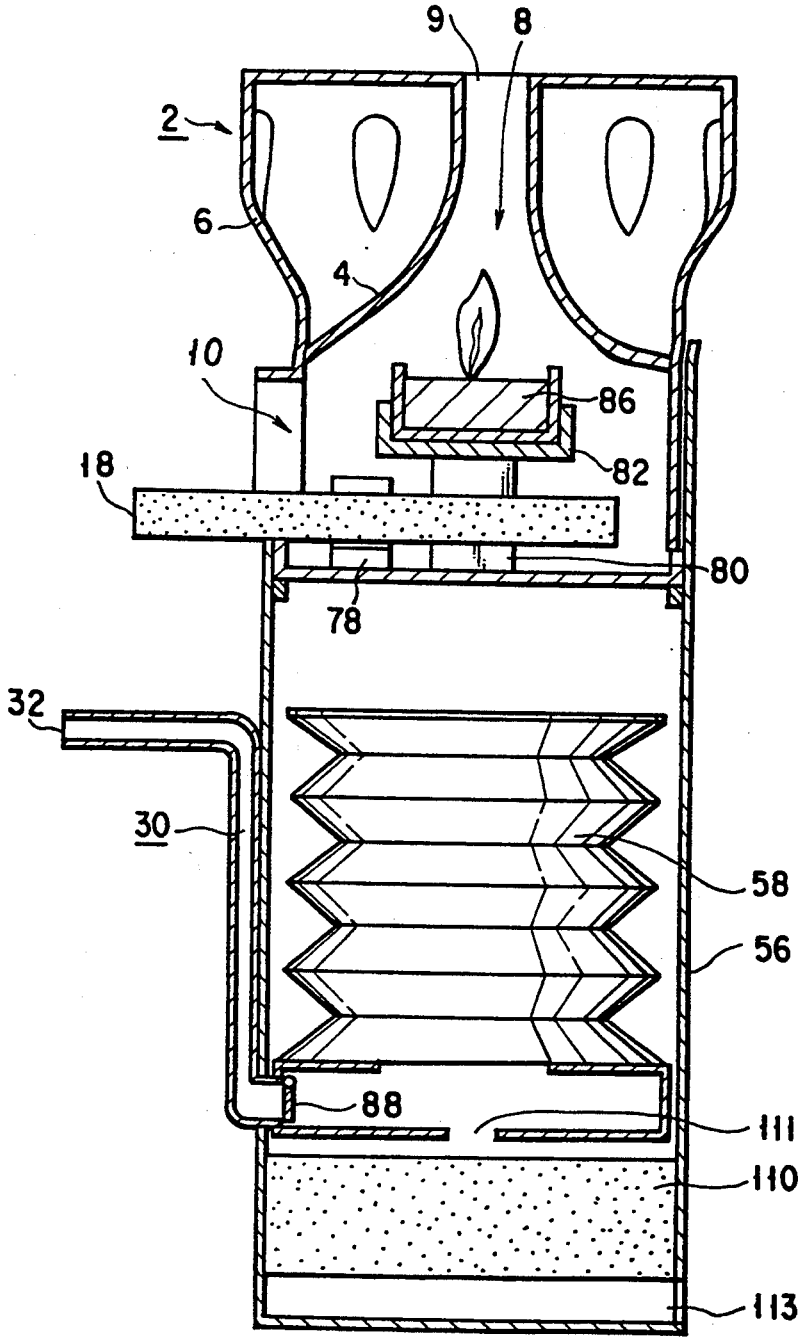
FIG. 20 is a cross-sectional view showing a smoking device according to an eighth embodiment of the invention.

FIG. 20 shows an eighth embodiment of the invention. The main-flow smoke pipe 30 communicates with the bellows-type gas collector 58 via a check valve 88. Further, the gas collector 58 communicates with an exhaust port 113 via an exhaust hole 111 and a purifying unit 110. The purifying unit 110 comprises a purifying member such as a filter, activated carbon or a minus-ion generator.

According to the eighth embodiment, main-flow smoke is fed to the bellows-type gas collector 58 via the pipe 30 and check valve 88. The volume of the gas collector 58 decreases gradually by its own weight, and the main-flow gas is fed to the purifying unit 110 via the exhaust hole 111. Thus, the main-flow smoke is purified and exhausted from the exhaust port 113. During this time, the sub-flow smoke is heat-decomposed by the candle 86 and resultant harmless gas is exhausted from the exhaust port 9.

Figure 21:
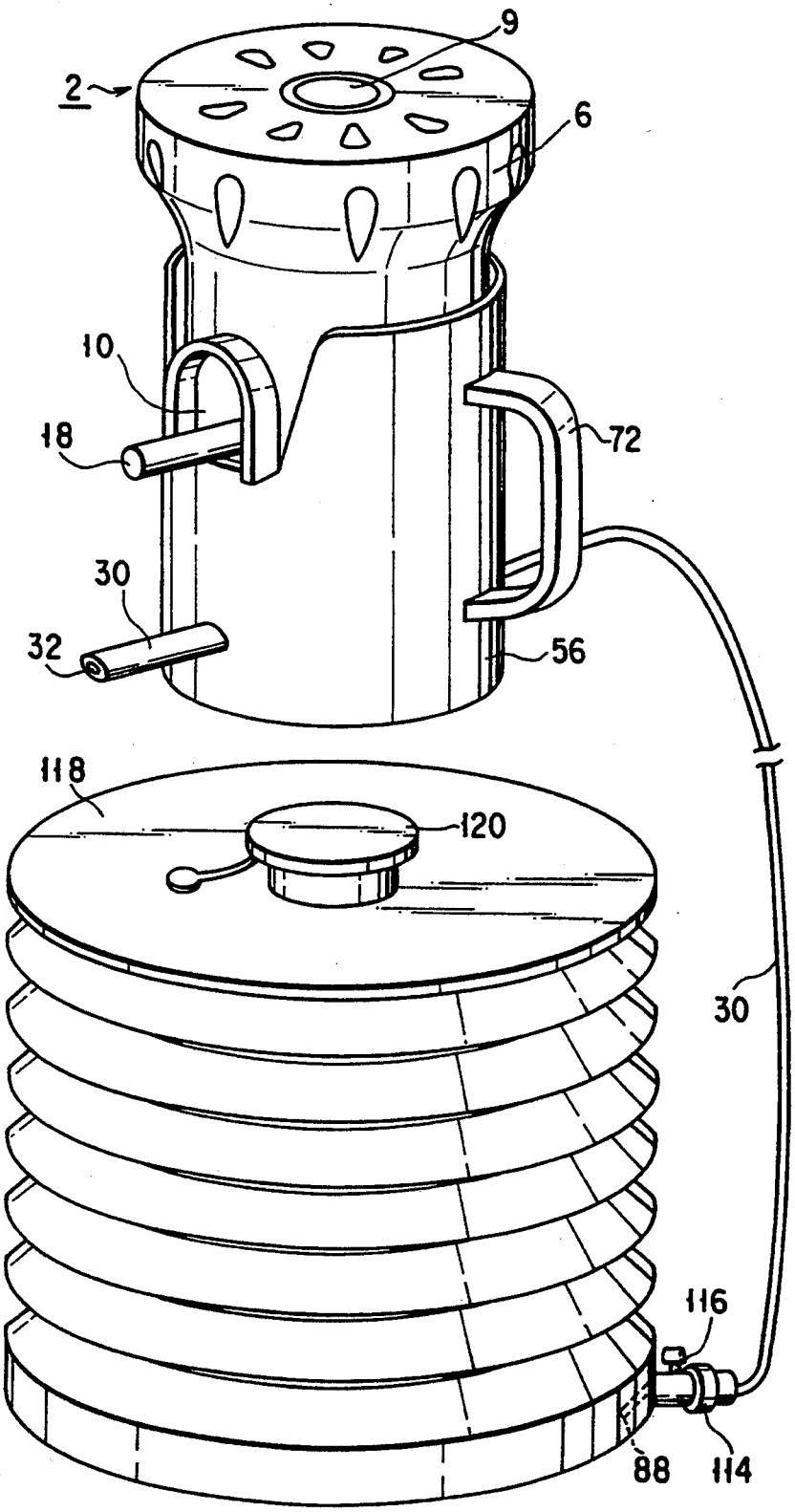
FIG. 21 is a perspective view showing a smoking device according to a ninth embodiment of the invention.

FIG. 21 shows a ninth embodiment of the invention. The main-flow smoke pipe 30 is provided with a check valve 88. The pipe 30 communicates with a large-sized gas collector 118 via a coupler 114, a cock 116 and check valve 88. The gas collector 118 is provided with a capped hole 120.

According to the ninth embodiment, the main-flow smoke is introduced into the pipe 30 and stored in the gas collector 118 via the check valve 88, coupler 114 and cock 116. During this the, the sub-flow smoke is heat-decomposed by the candle 86 and resultant harmless gas is exhausted from the exhaust port 9. When the gas collector 118 is filled with smoke gas, the cock 116 is closed and the collector 118 is separated from the coupler 114. The collector 118 is brought to the outdoors and the inside gas is exhausted from the hole 120.

The heat-decomposition method of detoxicating cigarette smoke is superior to other purifying methods. However, there has been a problem with main-flow smoke containing much gas, and the heat-decomposition method has not been put into practice. For example, there is a conventional heat-decomposition method in which the smoker's mouth is put in direct contact with a sub-flow smoke heat decomposition pipe and main-flow smoke is introduced into the sub-flow smoke heat-decomposition pipe. In this method, the flame in the heating unit may be extinguished, or heating is not efficiently performed. Thus, much heat energy is wasted. More specifically, the gas volume of sub, flow smoke is small and about 0.02 liter/second, and the heat capacity of the heating means may be small accordingly. Thus, the heat-decomposition method is effective for the sub-flow smoke, but the gas volume of the main-flow smoke is 1 liter/second at maximum. Thus, the flame of the heating means may be put out, and heating is difficult. Heat-decomposition of the main-flow smoke requires the heat quantity 50 times as large as that required for heat-decomposing the main-flow smoke. Therefore, heat energy is wasted and the safety against fire is not ensured.

This problem is solved in the third embodiment (FIGS. 10 to 12) by providing the main-flow smoke pipe 30 independently from the sub, flow smoke heat-decomposition pipe. By providing the pipe 30, the main-flow smoke is directed to the flame of the heating unit, and the main-flow smoke can be intensively processed with high efficiency without extinguishing the flame of the heating unit.

According to the fourth to sixth embodiments (FIGS. 13, 14 and 17), the main-flow smoke controlled by the technique of the third embodiment is processed with higher efficiency by various methods. In the fourth to sixth embodiments, the main-flow smoke is temporarily stored in the bellows-type gas collector 58 and then gradually fed to the heating unit comprising candle 86, etc. Thus, the main-flow smoke can be heat-decomposed by a small amount of heat.

In the seventh embodiments( FIG. 19), the main-flow smoke is introduced into the contractile gas collector 112, and the smoke in the collector 112 is inhaled via the purifying unit in a closed cycle system, thereby preventing the smoke from leaking to the outside.

In the eighth embodiment (FIG. 20), the main-flow smoke is temporarily stored in the bellows-type gas collector 58, and the smoke is gradually fed to the purifying unit 110. Thus, the purifying effect is remarkably enhanced. Since the main-flow smoke contains a less amount of harmful substances than the sub-flow smoke, the main-flow smoke can be purified by the purifying unit 110 comprising the filter, activated carbon, etc.

According to the ninth embodiment (FIG. 21), the main-flow smoke can be stored in the large-sized gas collector 118.

Use of the burner device shown in FIG. 4 can adjust the flame according to the amount of the exhaled main-flow smoke. As a result, a danger due to heat is low, and heat energy is saved.

As has been described above, the device of the present invention can purify the main-flow smoke and sub-flow smoke of cigarette 18 and is very practical.

Figure 22:
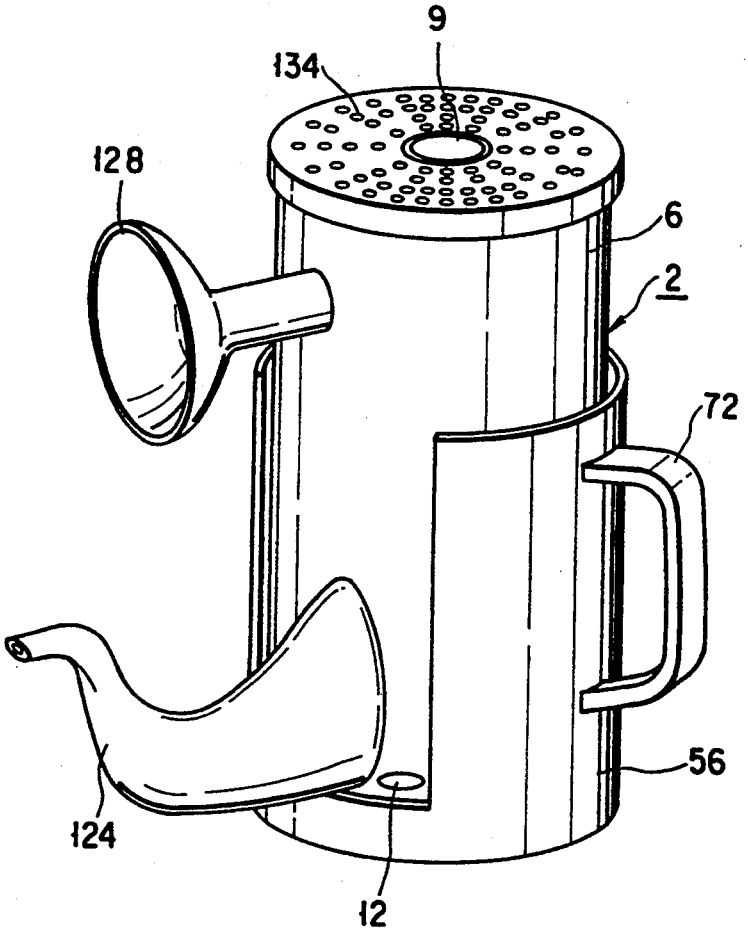
FIG. 22 is a perspective view showing a smoking device according to a tenth, embodiment of the invention.
Figure 23:
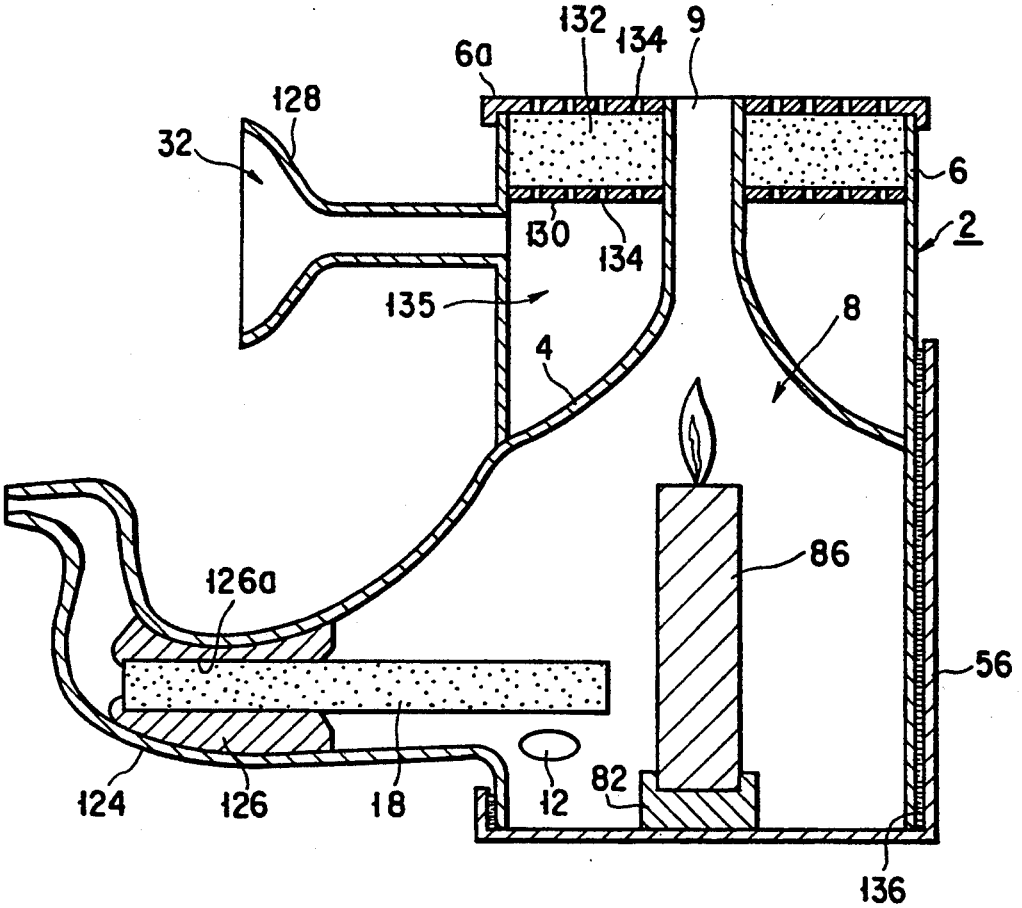
FIG. 23 is a cross-sectional view of the smoking device shown in FIG. 22.

FIGS. 22 and 23 show a tenth embodiment of the invention. A third housing 56 is a container structure in which a housing assembly 2 is fitted. A candle receiver 82 is provided within the third housing 56, and a candle 86 is attached on the receiver 82. The third housing 56 is provided with a handle 72. A mouthpiece portion 124 is formed integral with the lower part of the first housing 4. A cigarette supporting member is attached in the mouthpiece portion 124. An air-supply hole 12 for supplying air for combustion is formed in the mouthpiece portion 124.

The second housing 6 is integrally provided with a main-flow smoke inlet 32 (inlet pipe 128). The inlet 32 has such a size as to cover the smoker's mouth for easy exhalation of main-flow smoke and has a shape like a bell flare or a mouthpiece of a trumpet.

An auxiliary plate 130 is attached to the upper part of the second housing 6. A purifying agent 132 is put between the plate 130 and a top plate **6*a* of the second housing 6. The top, plate 6*a* and auxiliary plate 130 are provided with vent holes 134. The air including main-flow smoke introduced in the space 135 defined by the first housing 4 and second housing 6 is purified. The purifying agent 132** comprises activated carbon, a fiber filter with electrostatic effect, or a minus-ion generator.

The candle 86 may contain a perfume so as to emit fragrance during combustion.

The inner periphery of the third housing 56 is provided with electrostatic fiber portion 136, for easy engagement with the housing assembly 2. The fiber portion 136 may be attached to lower part of the outer periphery of the housing assembly 2. It is possible to form part or all of the housing assembly 2 of transparent glass or transparent heat-resisting glass, thereby making use of the light of the candle 86 for illumination. In addition, the housing assembly may be formed of a newly developed light-transmissive ceramic material.

By forming all or part of the housing assembly 2 of a transparent material, the burning portion of cigarette 18 can be seen and the remaining portion of cigarette 18 can be confirmed. In the case that the housing assembly 2 is not transparent, grooves extending along the longitudinal axis of cigarette 18 are formed on the inner surface of a cigarette engagement hole **126*a* of a ceramic or metallic cigarette holder 126. Thereby, the cigarette 18 can be inserted into the hole 126*a* with suitable frictional resistance and the degree of insertion of cigarette 18 can be adjusted. The fire of cigarette 18 is extinguished by heat absorption at the insertion area of the cigarette holder 126. In the case that the housing assembly 2 is formed of a metallic material, an noninflammable heat-insulating cover made of, e.g., glass fibers, may be put on the surface of the housing assembly 2 in order to protect the smoker against heat. The main-flow smoke inlet 32** may be formed to have a shape mating with the mouth for sure contact, and it may be coated with a rubber cushion, etc.

Figure 24:
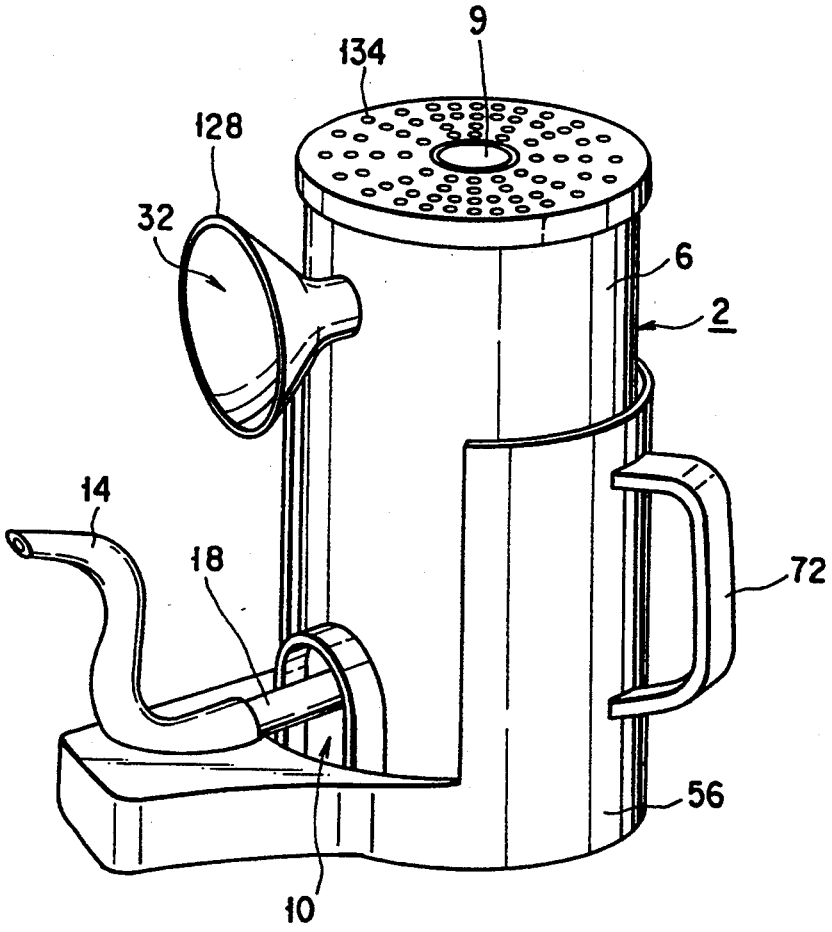
FIG. 24 is a perspective view showing a smoking device according to an eleventh embodiment of the invention.
Figure 25:
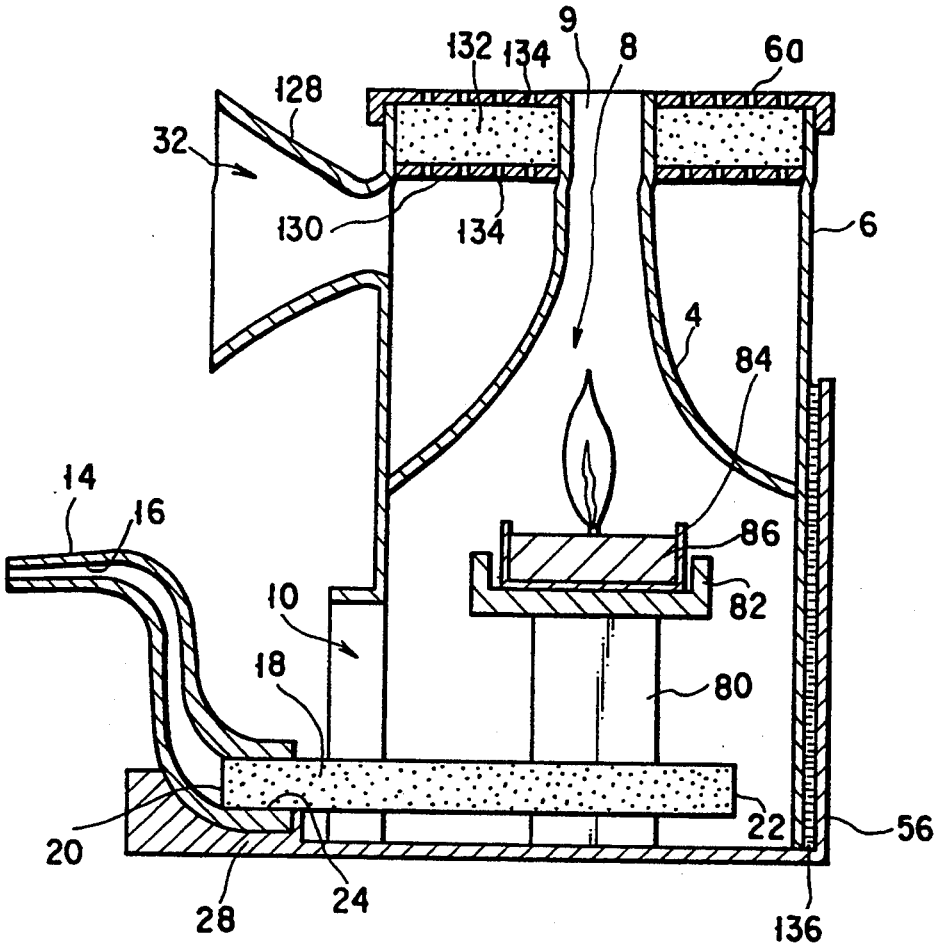
FIG. 25 is a cross-sectional view of the smoking device shown in FIG. 24.

FIGS. 24 and 25 show an eleventh embodiment of the invention. Unlike the tenth embodiment, a mouthpiece 14 is used in the eleventh embodiment. A cigarette 18 is attached to the mouthpiece 14, and then the mouthpiece 14 is inserted into the opening 10. As is shown in FIG. 25, a candle 86 is supported by a candle case 82 and a support leg 80 within the heating chamber 8, and it is situated above the cigarette 18. By this structure, the size of the entire Smoking device can be reduced. In the case where the housing assembly 2 is not formed of a transparent material, the burning end 22 of cigarette 18 is surely extinguished by heat absorption at the cigarette insertion opening of mouthpiece 14 if the length of second hole 24 of mouthpiece 14 is increased and the length of insertion of cigarette 18 is adjusted. According to another method of extinguishing the burning end portion 22, a movable pinching member can be used.

The manufacturing process can be simplified by the structure in which the mouthpiece portion 124 is formed integral with the housing assembly 2, as shown in FIG. 23. On the other hand, if the mouthpiece 14 is formed independently from the housing assembly 2, the size of the entire device can be reduced. These structures have both advantages and disadvantages.

In addition, the mouthpiece 14 and the third housing 56 may be formed as one unit, although not shown. By using the candle container 84, removal and of candle 86 and spilling of molten wax can be prevented.

Figure 26:
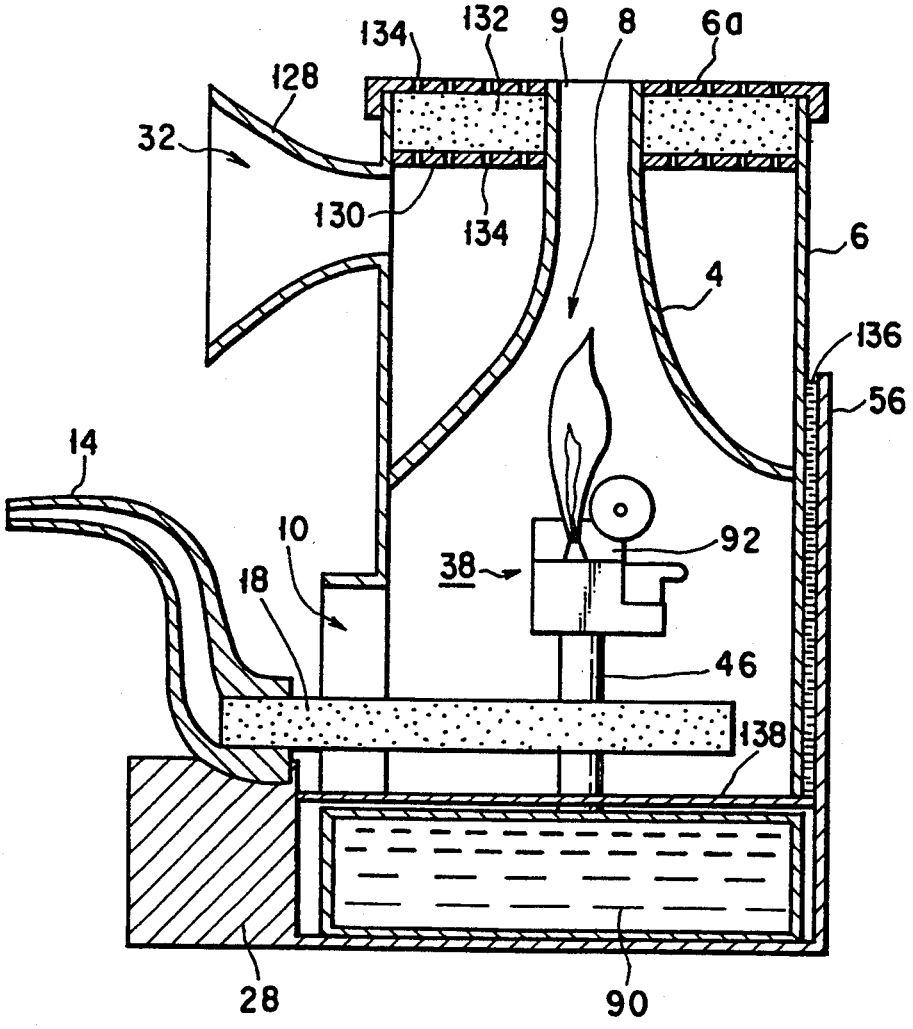
FIG. 26 is a cross-sectional view showing a smoking device according to a twelfth embodiment of the invention.

FIG. 26 shows a twelfth embodiment of the invention. In this embodiment, the candle 86 is replaced by a cigarette lighter-type device in which a fuel tank of oil or gas is combined with an ignition device. A combustion device 38 comprises a fuel tank 90, a fuel jet pipe 46, an ignition device 92 and a heat-shielding wall 138. The combustion device 38 is mounted in the third housing 56. The fuel jet pipe 46 is bent so as to avoid contact with cigarette 18, and the ignition device 92 is attached to the top portion of the pipe 46. In addition, the ignition device 92 of FIG. 26 can be replaced with that of FIG. 14.

Figure 27:
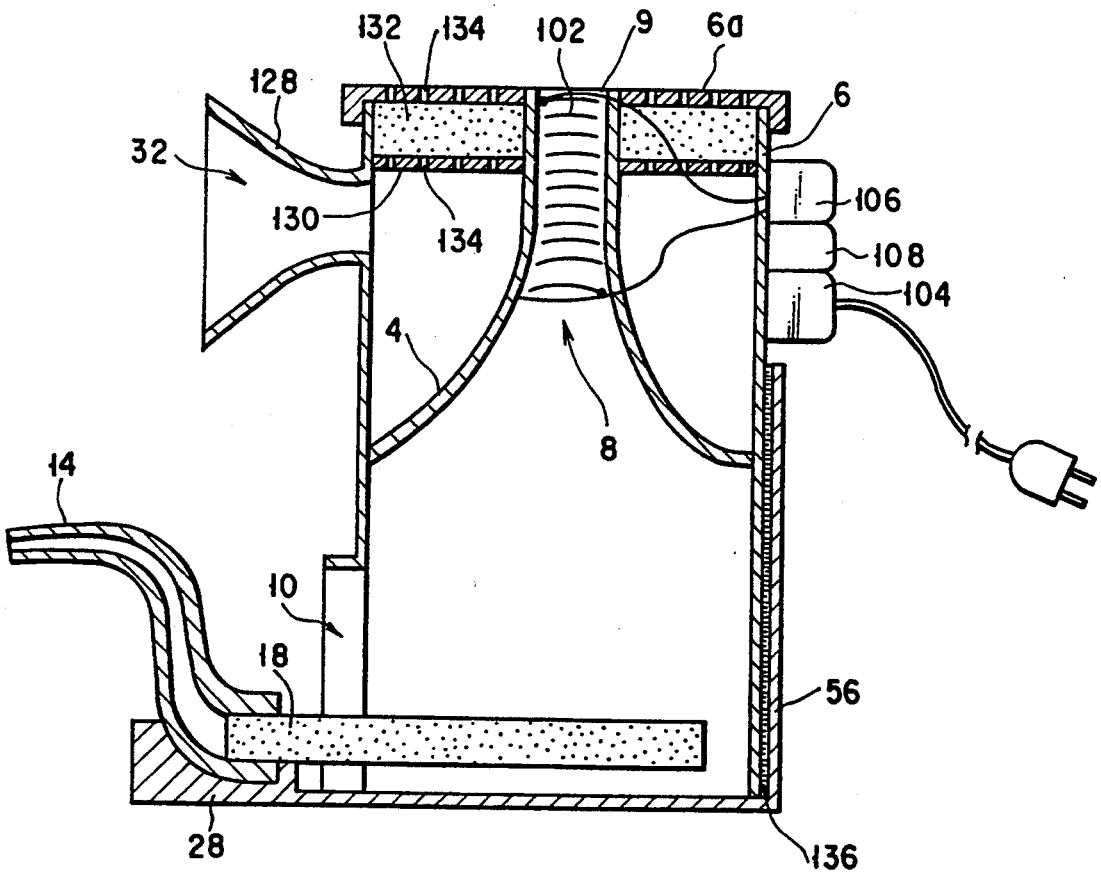
FIG. 27 is a cross-sectional view showing a smoking device according to a 13th embodiment of the invention.

FIG. 27 shows a 13th embodiment of the invention. The candle 86 is replaced by a combination of an electric heater unit 102, a light emission unit 106, a timer switch 108 and a switch 104. This combination is attached to the housing assembly 2. The light emission unit 106 is used to confirm the supply of electric power. The timer switch 108 is used to automatically turn off the switch 104 on the basis of the average time taken to smoke a single cigarette, thus preventing a fire from occurring due to the user forgetting to turn off the switch.

Figure 28:
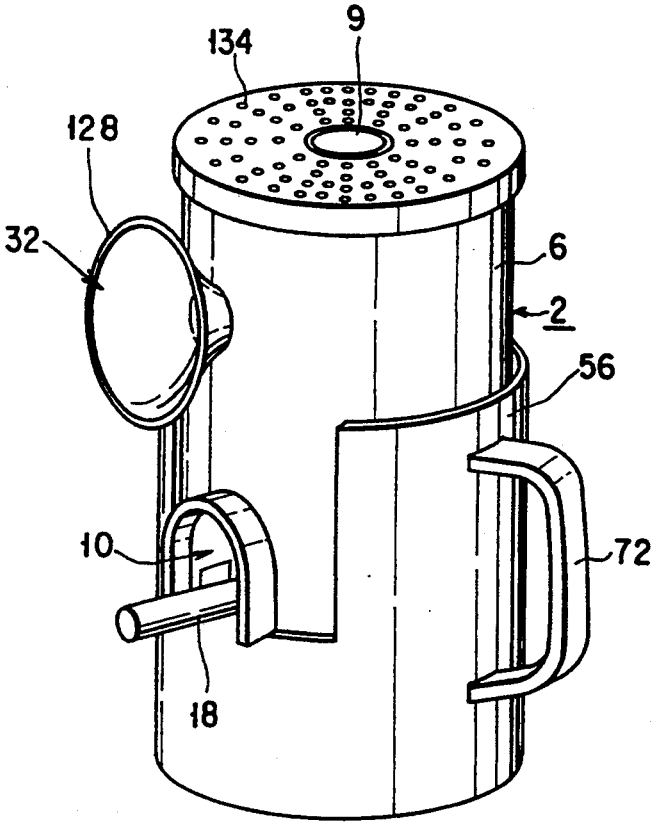
FIG. 28 is a cross-sectional view showing a smoking device according to a 14th embodiment of the invention.
Figure 29:
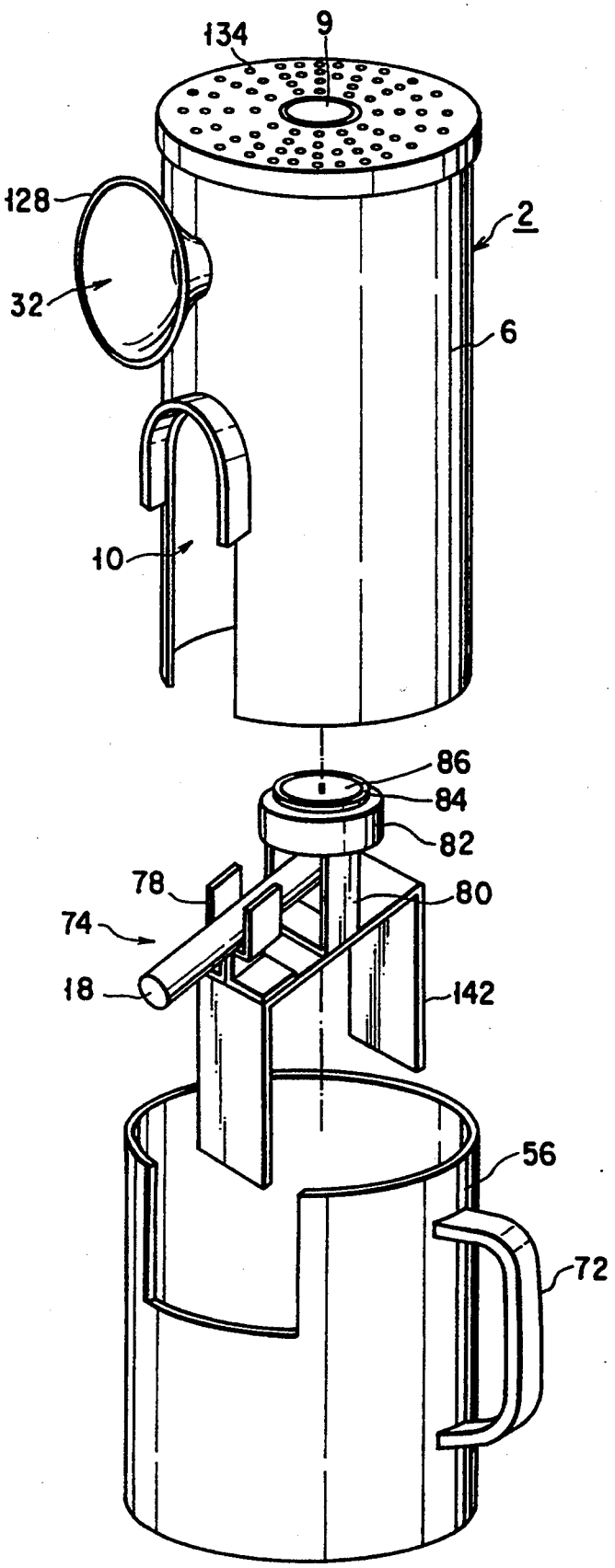
FIG. 29 is an exploded perspective view of the smoking device shown in FIG. 28.
Figure 30:
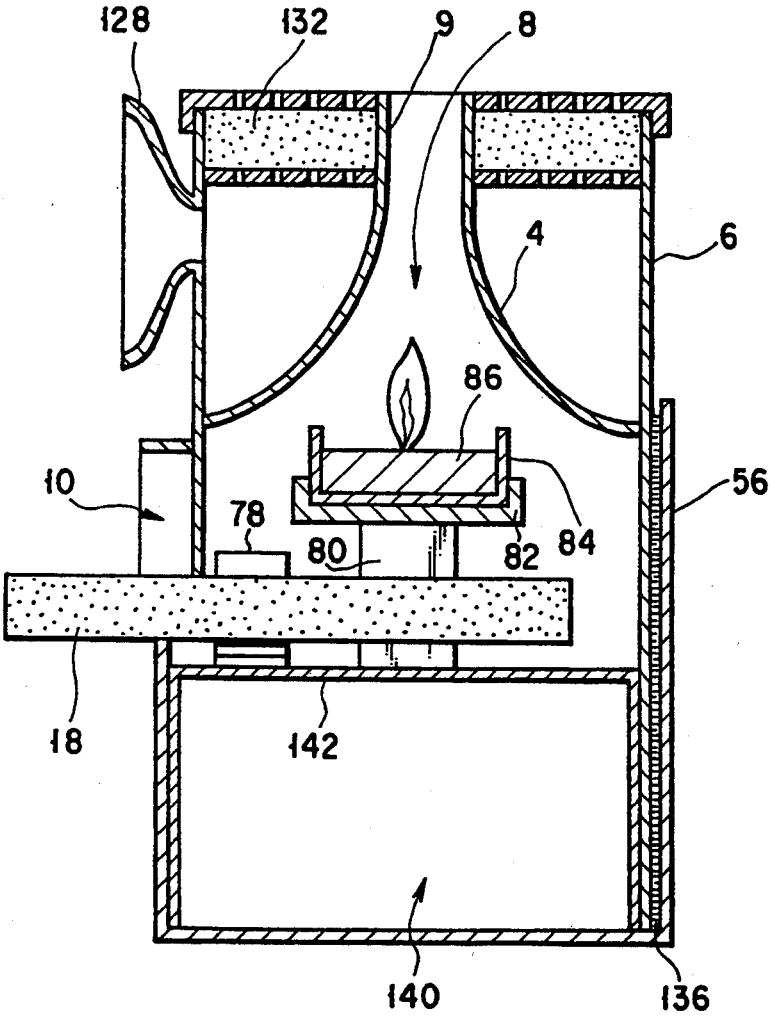
FIG. 30 is a cross-sectional view of the smoking device shown in FIG. 28.

FIGS. 28 to 30 show a 14th embodiment of the invention. In this embodiment, cigarette 18 is attached to a supporting mechanism 74, and the mouthpiece portion 124 or mouthpiece 14 is omitted. The support mechanism 74 has a leg unit 142 as a base.

The leg unit 142 has a relatively large length. Thus, when the support mechanism 74 is situated within the third housing 56, a space 140 is defined between the third housing 56 and the leg unit 142, as shown in FIG. 30. The space 140 can be used as ashtray. A purifying member (not shown) may be put in the space 140, and another main-flow smoke inlet 32 may be connected to the space 140. At the time of smoking, the position of cigarette 18 attached to the supporting mechanism 74 can be adjusted, thereby determining the position of heat-absorption extinction of cigarette 18. In addition, a slidable pinch may be attached to extinguish cigarette 18 at a desired position.

Figure 31:
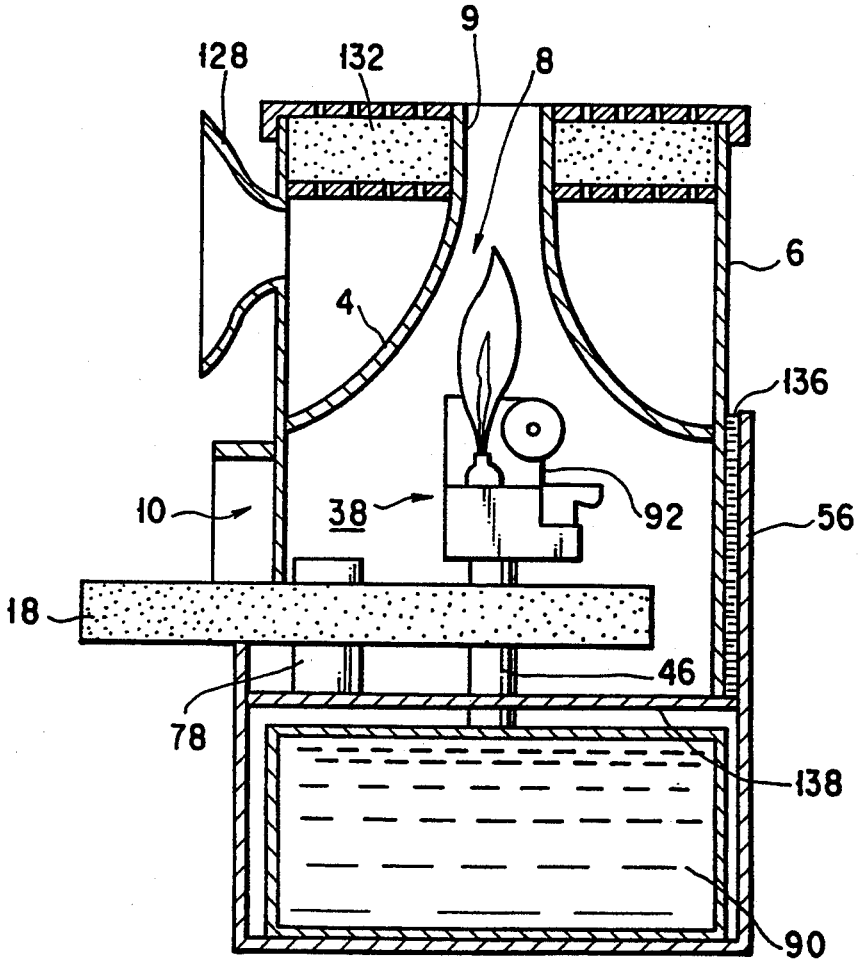
FIG. 31 is a cross-sectional view showing a smoking device according to a 15th embodiment of the invention.

FIG. 31 shows a 15th embodiment of the invention, in which the 14th embodiment shown in FIG. 14 is modified. There is provided a cigarette lighter-type combustion device 38 comprising a fuel tank 90 and an ignition device 92.

Figure 32:
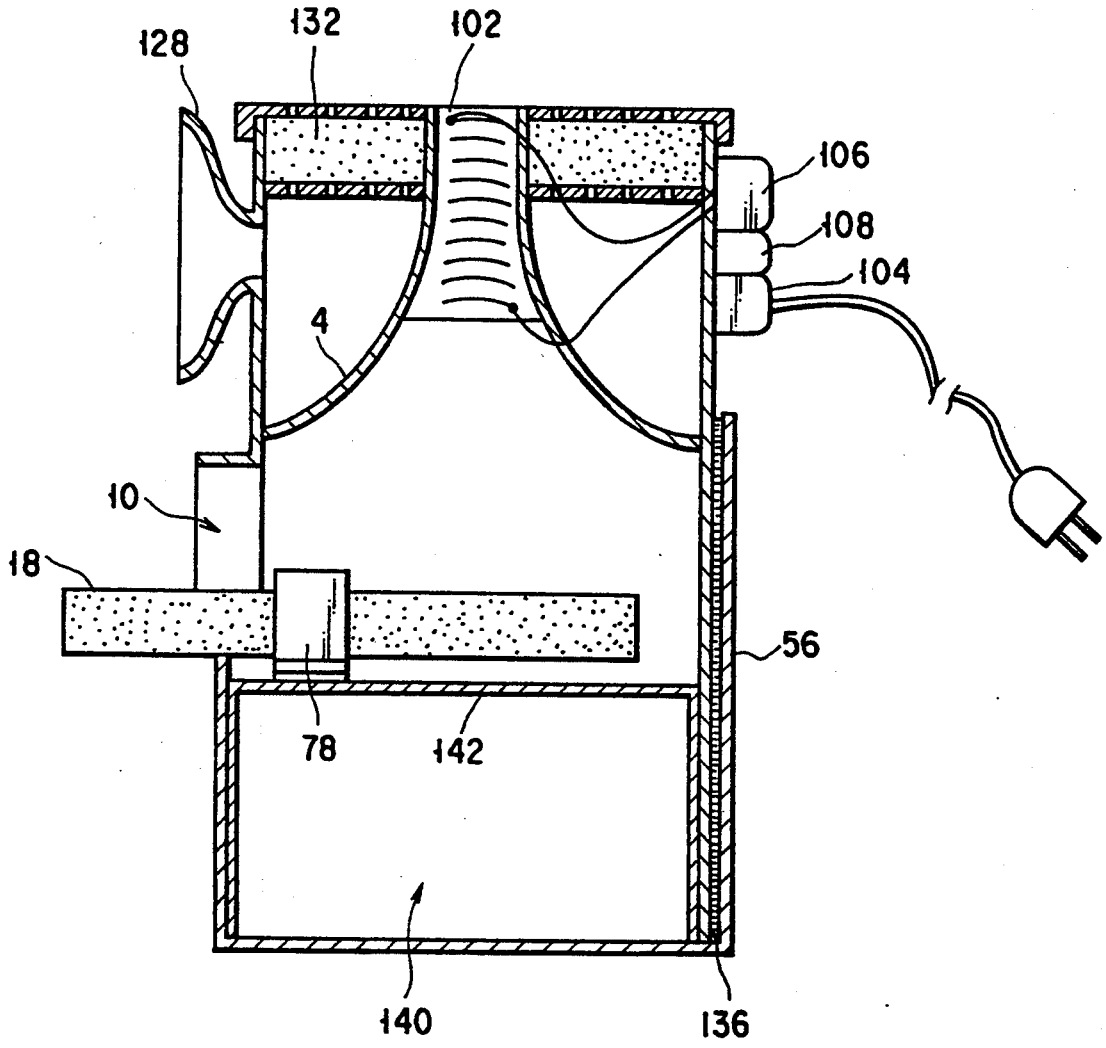
FIG. 32 is a cross-sectional view showing a smoking device according to a 16th embodiment of the invention.

FIG. 32 shows a 16th embodiment of the invention, in which the combustion device 18 is replaced by an electric heater unit 102 attached to an exhaust port 102. Like the embodiment of FIG. 30, the long leg unit 142 is used, and the cigarette 18 is attached to the supporting member 78 at a desired position. The space below the leg unit 142 can be used as ashtray.

In the 10th to 16th embodiments, all sub-flow smoke created by the cigarette burnt, which contains harmful substances, is heat-decomposed, and the main-flow smoke containing less harmful substances is purified by the purifying unit.. Thus, the gas is processed by the optimal method, and therefore harmful effects of cigarette smoke can effectively be prevented by the practical method.

The harmful substances of the sub-flow smoke is completely burnt by heat-decomposition, and the sub-flow smoke is changed to harmless smoke. When the cigarette smoke is inhaled, air is fed to the burning end of the cigarette. Thus, the main-flow smoke contains less harmful substances than the sub-flow smoke resulting from smoldering. In addition, since the main-flow smoke is exhaled by the smoker after it is subjected to, so to speak, a purifying process in the lungs, the amount of harmful substances is reduced. In the 10th to 16th embodiments, this main-flow smoke is introduced into the purifying member. Since the force of introduced gas is several times as strong as the air blown by a small fan or the like, the density and amount of the purifying member can be increased.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A smoking device for smoking a cigarette having a tip end portion, through which a main-flow smoke passes as it is inhaled by a user, and a burning end portion, which produces a sub-flow smoke, the smoking device comprising:

a housing defining a heating chamber having an exhaust port, an air port and an opening which all communicate with the heating chamber, said heating chamber defining a sub-smoke passage for guiding a sub-flow smoke;

supporting means attached to the housing capable of supporting the cigarette such that the burning end portion of the cigarette is located within the heating chamber;

a main-smoke passage attached to the housing for guiding a main-flow smoke, having a first end portion, from which the main-flow smoke is introduced, and a second end portion from which the main-flow smoke is exhausted;

heat-decomposition means located within the housing for heating and decomposing at least one of the component of the main-flow smoke and the component of sub-flow smoke; and a heat amount controller for controlling the heat amount in the heating chamber produced by the heat-decomposition means, in accordance with the air containing the main-flow smoke.

2. A smoking device for smoking a cigarette having a tip end portion, through which a main-flow smoke passes as it is inhaled by a user, and a burning end portion, which produces a sub-flow smoke, the smoking device comprising:

a housing defining a heating chamber having an exhaust port, an air port and an opening which all communicate with the heating chamber, said heating chamber defining a sub-smoke passage for guiding a sub-flow smoke;

supporting means attached to the housing capable of supporting the cigarette such that the burning end portion of the cigarette is located within the heating chamber;

a main-smoke passage attached to the housing for guiding a main-flow smoke, having a first end portion, from which the main-flow smoke is introduced, and a second end portion from which the main-flow smoke is exhausted; and heat-decomposition means located within the housing for heating and decomposing at least one of the component of the main-flow smoke and the component of sub-flow smoke, the heat-decomposition means includes a timer device for limiting the time of heating by the heat-decomposition means, in accordance with the time of burning the cigarette.

3. A smoking device for smoking a cigarette having a tip end portion, through which a main-flow smoke passes as it is inhaled by a user, and a burning end portion, which produces a sub-flow smoke, the smoking device comprising:

a housing defining a heating chamber having an exhaust port, an air port and an opening which all communicate with the heating chamber, said heating chamber defining a sub-smoke passage for guiding a sub-flow smoke;

supporting means attached to the housing capable of supporting the cigarette such that the cigarette generates a sub-flow smoke within said heating chamber;

heat-decomposition means located within the housing for heating and decomposing at least a component of the sub-flow smoke within the heating chamber, said heat-decomposition means having a combustion device which produces a flame having a tip; and a main-smoke passage attached to the housing for guiding a main-flow smoke, having a first end portion, from which the main-flow smoke of the cigarette is introduced separately from the sub-smoke passage, and a second end portion from which the main-flow smoke is exhausted, the second end portion of the main-smoke passage is located within the heating chamber and surrounds the flame of the combustion device so as to direct the main-flow smoke towards the tip of the flame of the combustion device.

4. A smoking device for smoking a cigarette having a tip end portion, through which a main-flow smoke passes as it is inhaled by a user, and a burning end portion, which produces a sub-flow smoke, the smoking device comprising:

a housing defining a heating chamber having an exhaust port, an air port and an opening which all communicate with the heating chamber, said heating chamber defining a sub-smoke passage for guiding a sub-flow smoke;

supporting means attached to the housing capable of supporting the cigarette such that the cigarette generates a sub-flow smoke within said heating chamber;

heat-decomposition means located within the housing for heating and decomposing at least a component of the sub-flow smoke within the heating chamber;

a heat amount controller for controlling the heat amount in the heating chamber produced by the heat-decomposition means, in accordance with the air containing the main-flow smoke; and a main-smoke passage attached to the housing for guiding a main-flow smoke, having a first end portion, from which the main-flow smoke of the cigarette is introduced separately from the sub-smoke passage, and a second end portion from which the main-flow smoke is exhausted.

5. A smoking device for smoking a cigarette having a tip end portion, through which a main-flow smoke passes as it is inhaled by a user, and a burning end portion, which produces a sub-flow smoke, the smoking device comprising:

a housing defining a heating chamber having an exhaust port, an air port and an opening which all communicate with the heating chamber, said heating chamber defining a sub-smoke passage for guiding a sub-flow smoke;

supporting means attached to the housing capable of supporting the cigarette such that the cigarette generates a sub-flow smoke within said heating chamber;

heat-decomposition means located within the housing for heating and decomposing at least a component of the sub-flow smoke within the heating chamber, the heat-decomposition means includes a timer device for limiting the time of heating by the heat decomposition means, in accordance with the time of burning of the cigarette; and a main-smoke passage attached to the housing for guiding a main-flow smoke, having a first end portion, from which the main-flow smoke of the cigarette is introduced separately from the sub-smoke passage, and a second end portion from which the main-flow smoke is exhausted.

* * * * *

UNITED STATES PATENT AND TRADEMARK OFFICE

CERTIFICATE OF CORRECTION

PATENT NO. : 5,402,803

DATED : April 4, 1995

INVENTOR(S) : Seiichi Takagi

It is certified that error appears in the above-indentified patent and that said Letters Patent is hereby corrected as shown below:

Column 4, line 10, delete "thee" and insert therefor --the--.

Column 5, line 57, delete "teat" and insert therefor --heat--.

Column 6, line 47, after "heating chamber," insert --8--.

Column 8, line 15, delete "FIGS" and insert therefor --FIG--.

Column 8, line 25, delete "an" and insert therefor --a--.

Column 9, line 65, delete "sub, flow" and insert therefor --sub-flow--.

Column 10, line 11, delete "sub, flow" and insert therefor --sub-flow--.

Column 12, line 45, delete "18" and insert therefor --38--.

Signed and Sealed this

Twenty-eighth Day of November 1995

*Attest:*

Bruce Lehman

BRUCE LEHMAN

*Attesting Officer*

*Commissioner of Patents and Trademarks*